US008811645B2

(12) United States Patent
Inoda et al.

(10) Patent No.: US 8,811,645 B2
(45) Date of Patent: Aug. 19, 2014

(54) DIFFERENTIAL MICROPHONE UNIT AND MOBILE APPARATUS

(75) Inventors: Takeshi Inoda, Osaka (JP); Ryusuke Horibe, Osaka (JP); Fuminori Tanaka, Osaka (JP); Syuzi Umeda, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 46 days.

(21) Appl. No.: 13/514,289

(22) PCT Filed: Dec. 8, 2010

(86) PCT No.: PCT/JP2010/071955

§ 371 (c)(1),
(2), (4) Date: Jun. 6, 2012

(87) PCT Pub. No.: WO2011/071055

PCT Pub. Date: Jun. 16, 2011

(65) Prior Publication Data

US 2012/0243721 A1 Sep. 27, 2012

(30) Foreign Application Priority Data

Dec. 9, 2009 (JP) ..... 2009-279379

(51) Int. Cl.

| | |
|---|---|
| ***H04R 9/08*** | (2006.01) |
| ***H04R 1/32*** | (2006.01) |
| ***H04R 1/34*** | (2006.01) |
| ***H04R 1/38*** | (2006.01) |

(52) U.S. Cl.

CPC .. *H04R 1/32* (2013.01); *H04R 1/34* (2013.01); *H04R 1/342* (2013.01); *H04R 1/38* (2013.01)

USPC ..... 381/357; 381/355; 381/356; 381/358; 381/360

(58) Field of Classification Search

CPC ..... H04R 1/32; H04R 1/34; H04R 1/342; H04R 1/38

USPC ..... 381/336, 355–358, 360

See application file for complete search history.

(56) References Cited

U.S. PATENT DOCUMENTS 5,539,834 A * 7/1996 Bartlett et al. ..... 381/170
6,831,987 B2 * 12/2004 Killion et al. ..... 381/313

(Continued)

FOREIGN PATENT DOCUMENTS

JP H06-284494 A 10/1994
JP H10-285259 A 10/1998

(Continued)

OTHER PUBLICATIONS

International Search Report, dated Apr. 12, 2011.

(Continued)

*Primary Examiner* — Curtis Kuntz
*Assistant Examiner* — Ryan Robinson
(74) *Attorney, Agent, or Firm* — Amster, Rothstein & Ebenstein, LLP

(57) ABSTRACT

Disclosed is a differential microphone unit which can improve the characteristics of a microphone unit and widen the directional range thereof. The disclosed differential microphone unit (100) is provided with: a microphone housing (20) which is provided with a pair of first sound holes (22*a*, 22*b*) on the same major surface (20*a*); a vibrating portion (11) which is disposed in the microphone housing and which vibrates according to differences in sound pressure transmitted via each of the pair of first sound holes; and sealing members (30, 130), which are disposed on the major surface of the microphone housing and which each contain a pair of second sound holes (31*a*, 31*b*, 131*a*, 131*b*) disposed so as to be in respective contact with the pair of first sound holes. The opening length (L3) of the pair of second sound holes, which are in the sealing members on the opposite surface to the microphone housing side thereof, in a second direction perpendicular to a first direction in which the first sound holes are aligned, is larger than the opening length (L1) of the first sound holes in the second direction, which are on the major surface of the microphone housing.

20 Claims, 8 Drawing Sheets

(56) References Cited

U.S. PATENT DOCUMENTS

| | | | | |
|---|---|---|---|---|
| 6,885,751 | B2 * | 4/2005 | Pribyl | 381/174 |
| 8,284,966 | B2 * | 10/2012 | Wilk et al. | 381/189 |
| 8,295,527 | B2 * | 10/2012 | Chen | 381/365 |
| 8,295,528 | B2 * | 10/2012 | Rombach et al. | 381/369 |
| 8,457,342 | B2 * | 6/2013 | Tanaka et al. | 381/357 |
| 2011/0261987 | A1 | 10/2011 | Nakanishi et al. | |

FOREIGN PATENT DOCUMENTS

| | | | |
|---|---|---|---|
| JP | 2002191089 | A | 7/2002 |
| JP | 2007178133 | A | 7/2007 |
| JP | 2008211466 | A | 9/2008 |
| JP | 2009100178 | A | 5/2009 |
| WO | WO2009034786 | A1 | 3/2009 |

OTHER PUBLICATIONS

Written Opinion by International Search Authority dated Apr. 12, 2011.
English Abstract of JP 2002-191089.
English Abstract of JP 2007-178133.
English Abstract of JP 2008-211466.
English Abstract of JP 2009-100178.
English Abstract of JP 2010-285259.
English Abstract of JP 2006-284494.

* cited by examiner

DIRECTIVITY PATTERN POSSESSED BY DIFFERENTIAL MICROPHONE UNIT IN A CASE OF HAVING NO GASKET (SEALING MEMBER) (COMPARATIVE EXAMPLE)

RESULTS OF MEASUREMENT OF DIRECTIVITY CHARACTERISTIC (1KHz)

DIFFERENTIAL MICROPHONE UNIT AND MOBILE APPARATUS

CROSS-REFERENCE TO RELATED APPLICATIONS

This application is a U.S. national stage entry under 35 U.S.C. §371 of PCT International Application No. PCT/JP2010/071955, filed on Dec. 8, 2010, and claims priority to Japanese Application No. JP 2009-279379, filed on Dec. 9, 2009, the contents of which are incorporated herein by reference in their entirety.

FIELD OF THE INVENTION

The present invention relates to a differential microphone unit and a mobile apparatus, and more particularly, it relates to a differential microphone unit and a mobile apparatus each including a microphone housing and a vibrating portion.

BACKGROUND ART

In general, a microphone apparatus or the like including a microphone housing and a vibrating portion is known. Such microphone apparatus are disclosed in Japanese Laid-Open Patent Application No. 2002-191089 and Japanese Laid-Open Patent. Application No. 2007-178133, for example.

In Japanese Laid-Open Patent Application No. 2002-191089, there is disclosed a noise-canceling microphone including a sound case in the form of a tubular container, a diaphragm arranged in this sound case and an acoustoelectric conversion unit arranged in the sound case for converting vibration of the diaphragm to an electric signal. In this noise-canceling microphone, a plurality of sound input holes whose number and magnitude (shape of openings) are properly adjusted are provided on each of the front surface, the back surface and the side surface of the sound case surrounding the diaphragm. Thus, the noise-canceling microphone is formed to be capable of canceling noise (background noise) made around the sound case by making the microphone reliably acquire sounds, included in external sounds, directly reaching the diaphragm from the front surface side of the sound case while making not only the sounds from the front surface side of the sound case but also sounds input from the sound input holes on the back surface and the side surface of the sound case reach the back surface side of the diaphragm at the same sound pressure level as that on the front surface side.

In Japanese Laid-Open Patent Application No. 2007-178133, there is disclosed a semiconductor device including a pressure sensor module in which a semiconductor chip (sound pressure sensor chip) is mounted on the surface of a plate material unit having one opening on the side surface and a bathtub-shaped lid body covering the pressure sensor module from above and having one opening on the upper surface. In this semiconductor device, the plate material unit is constituted of a base substrate in which a through-hole is provided at a position where the semiconductor chip is mounted and two sheet layers provided on the back surface of the base substrate and stacked in order of a first sheet layer and a second sheet layer from the side of the substrate. The base substrate and the second sheet layer hold the first sheet layer previously provided with a slit-like notched groove from both sides, thereby forming an external communication hole communicating with the exterior at the opening on the side surface of the plate material unit from the sound sensor chip (lower surface of a diaphragm) through the through-hole of the base substrate and the inner portion of the plate material unit in the inner portion (notched groove of the first sheet layer) of the plate material unit. Thus, this semiconductor device is constituted as a differential microphone apparatus detecting the difference between a sound pressure reaching the sound sensor chip (upper surface of the diaphragm) through the opening provided on the upper surface of the lid body and a sound pressure reaching the sound sensor chip (lower surface of the diaphragm) from an opening provided on a side portion of an apparatus body through the external communication hole in the plate material unit. The semiconductor device is so formed that the openings provided on the respective ones of the upper surface of the lid body and the side surface of the plate material unit are independently arranged at positions separating from each other.

PRIOR ART

Patent Document

Patent Document 1: Japanese Laid-Open Patent Application No. 2002-191089

Patent Document 2: Japanese Laid-Open Patent Application No. 2007-178133

SUMMARY OF THE INVENTION

Problems to be Solved by the Invention

In the noise-canceling microphone described in Japanese Laid-Open Patent Application No. 2002-191089, the plurality of sound input holes are provided on each of the front surface, the back surface and the side surface of the sound case so that the microphone is formed to have directivity picking up sound pressures only from the front surface side without picking up ambient noise (background noise), and the same is so formed that sound pressures (vibration of sound waves) to be picked up by the microphone are input not only from the front surface side of the sound case but also from the sound input holes on the back surface and the side surface of the sound case, and hence it is conceivable that there is such a case that the microphone is constituted in a state where the path length (transmission distance of a sound wave) of a sound reaching the diaphragm from the front surface side of the sound case and the path length (transmission distance of a sound wave) of a sound reaching the diaphragm from the side surface or the back surface of the sound case are remarkably different from each other. In this case, propagation time difference (phase difference) resulting from the difference between the respective path lengths from the front surface side and the back surface (side surface) side is caused in the sound case, and hence there is a reduction of omnidirectional noise suppression performance characterizing the differential microphone or such an inconvenience that a noise-suppressible frequency band narrows and the characteristics of the microphone degrade.

In the semiconductor device (differential microphone apparatus) described in Japanese Laid-Open Patent Application No. 2007-178133, the openings provided on the respective ones of the upper surface of the lid body and the side surface of the plate material unit are independently arranged on the positions separating from each other, and hence it is conceivable that there is such a case that the differential microphone apparatus is constituted in a state where the path length of a sound reaching the sound pressure sensor chip (upper surface of the diaphragm) from the opening provided on the upper surface of the lid body and the path length of a sound reaching the sound pressure sensor chip (lower surface of the diaphragm) from the opening provided on the side portion of the apparatus body through the external communication hole in the plate material unit are remarkably different from each other. In this case, propagation time difference (phase difference) resulting from the difference between the respective path lengths is caused in the differential microphone apparatus, and hence there is reduction of omnidirectional noise suppression performance characterizing the differential microphone or such an inconvenience that a noise-suppressible frequency band narrows and the characteristics of the microphone degrade.

In order to solve such an inconvenience that the characteristics (the omnidirectional noise suppression performance and the noise-suppressible frequency band) of the microphone in each of Japanese Laid-Open Patent Application No. 2002-191089 and Japanese Laid-Open Patent Application No. 2007-178133 degrade, it is also conceivable to provide a pair of sound input holes (openings) on the same surface. In the case of providing the pair of sound input holes on the same surface, however, the directivity (characteristic showing which angled sounds are to be clearly captured with excellent sensitivity as viewed from centers of the sound input holes) possessed by the microphone has bidirectivity, while an angular range in which no sensitivity is obtained in the directivity (an angle at which the microphone is incapable of picking up sounds, referred to as a Null range) also occurs at the same time. Thus, there is such a problem that it is difficult to further extend the range of the directivity possessed by the differential microphone apparatus due to the occurrence of the Null range.

The present invention has been proposed in order to solve the aforementioned problems, and an object of the present invention is to provide a differential microphone unit and a mobile apparatus each capable of improving the characteristics of the microphone unit and capable of further extending the range of directivity possessed by the microphone unit.

Means for Solving the Problems

A differential microphone unit according to a first aspect of the present invention includes a microphone housing in which a pair of first sound holes are provided on the same major surface, a vibrating portion arranged in the microphone housing for vibrating due to difference between sound pressures arriving through the respective ones of the pair of first sound holes and a sealing member, arranged on the major surface of the microphone housing, including a pair of second sound holes arranged to communicate with the respective ones of the pair of first sound holes, while the sealing member is so formed that, in a second direction orthogonal to a first direction where the pair of first sound holes align with each other, opening lengths of the respective ones of the pair of second sound holes on a surface of the sealing member opposite to the side of the microphone housing are larger than opening lengths of the first sound holes in the second direction on the major surface of the microphone housing.

As hereinabove described, the differential microphone unit according to the first aspect of the present invention includes the microphone housing in which the pair of first sound holes are provided on the same major surface, the vibrating portion arranged in the microphone housing and the sealing member, arranged on the major surface of the microphone housing, including the pair of second sound holes arranged to communicate with the respective ones of the pair of first sound holes, whereby sound pressures (vibration of sound waves) input in the differential microphone unit can be made to reach the vibrating portion in the microphone housing through the respective ones of the pair of second sound holes (first sound holes) arranged on the same major surface of the microphone housing. In other words, a differential microphone unit capable of inhibiting difference from increasing by substantially equalizing the path length (transmission distance (propagation time) of a sound wave) of a sound reaching the vibrating portion from one of the pair of sound holes and the path length (transmission distance (propagation time) of a sound wave) of a sound reaching the vibrating portion from the other one of the pair of sound holes to each other can be constituted. Thus, propagation time difference (phase difference) resulting from the difference between the respective path lengths can be reduced, whereby omnidirectional noise suppression performance possessed by the differential microphone unit is improved while a noise-suppressible frequency band is spread, and the characteristics of the differential microphone unit can be improved.

Further, the aforementioned differential microphone unit according to the first aspect includes the microphone housing, the vibrating portion and the sealing member arranged on the major surface of the microphone housing and the sealing member is so formed that, in the second direction orthogonal to the first direction where the pair of first sound holes align with each other, the opening lengths of the respective ones of the pair of second sound holes on the surface of the sealing member opposite to the side of the microphone housing are larger than the opening lengths of the first sound holes on the major surface of the microphone housing in the second direction, whereby the opening lengths of the second sound holes in the second direction are so larger than the opening lengths of the first sound holes that it becomes possible to stretch and extend the range of directivity possessed by the differential microphone unit along the second direction. In this case, the ranges of directivity formed by the respective ones of the pair of second sound holes are both stretched along the second direction, whereby an angular range in which no sensitivity is obtained in the directivity (an angle at which the microphone is incapable of picking up sounds, referred to as a Null range) formed by the pair of second sound holes adjacent to each other along the first direction is made more narrow. As a result of this, the range (sensitivity range) of the directivity possessed by the differential microphone unit can be further extended. In the aforementioned differential microphone unit according to the first aspect, the sealing member is so formed that the opening lengths of the respective ones of the pair of second sound holes on the surface of the sealing member opposite to the side in contact with the microphone housing are larger than the opening lengths of the first sound holes communicating with the respective ones of the pair of second sound holes in the second direction, whereby the range of the directivity possessed by the differential microphone unit can be more extended by adjusting the planar magnitudes (opening lengths) of the second sound holes on the side of the sealing member arranged on the major surface of the microphone housing without changing the planar magnitudes of the first sound holes on the side of the microphone housing. Thus, the magnitude of the microphone housing predominant over the size of the microphone unit may not be changed, whereby the size of the differential microphone unit can be inhibited from increasing.

Preferably in the aforementioned differential microphone unit according to the first aspect, the first sound holes are arranged in regions surrounded by inner side surfaces of the second sound holes communicating with the first sound holes in a plan view. According to this structure, the first sound holes of the microphone housing are arranged on regions inside the second sound holes of the sealing member in exposed states in a case where the microphone housing is viewed from the side of the sealing member, whereby such a state is avoided that the first sound holes are partially ensconced by the second sound holes. In other words, the first sound holes are not obstructed by the second sound holes, whereby the directivity possessed by the differential microphone unit can be retained to have a normal range.

Preferably in the aforementioned differential microphone unit according to the first aspect, central positions of the respective ones of the pair of first sound holes are arranged along the first direction in plan view. According to this structure, a range (sensitivity range) of directivity having a substantially symmetrical shape in the first direction with reference to the center of the differential microphone unit can be obtained. As a result of this, an angular range in which no sensitivity is obtained in the directivity (a Null range) can be symmetrically narrowed in the second direction with reference to the center of the differential microphone unit.

Preferably in the aforementioned differential microphone unit according to the first aspect, the opening lengths of the first sound holes in the second direction are larger than the opening lengths of the first sound holes in the first direction, and the opening lengths of the second sound holes in the second direction are larger than the opening lengths of the second sound holes in the first direction. According to this structure, the opening lengths of the first (second) sound holes in the second direction are larger than the opening lengths of the first (second) sound holes in the first direction as compared with a case of forming the first sound holes and the second sound holes in such circular shapes that the opening lengths of the respective ones in the first direction and the second direction are both substantially equal to each other, so that the range of the directivity possessed by the differential microphone unit can be preferentially stretched in the second direction, whereby the range of the directivity possessed by the differential microphone unit can be easily extended, as described above.

Preferably in this case, the pairs of first sound holes and second sound holes both have slot shapes extending along the second direction. According to this structure, the first sound holes and the second sound holes are formed in the slot shapes extending along the second direction, unlike a case where the same have rectangular shapes or triangular shapes including corner portions, so that the range of the directivity possessed by the differential microphone unit can be properly ensured.

Preferably in the aforementioned structure in which the pairs of first sound holes and second sound holes both have the slot shapes, the slot shapes are track shapes. According to this structure, end portions of the first sound holes and the second sound holes in the second direction can be constituted of smooth curves (curved surfaces), whereby a range (sensitivity range) of directivity having isotropy can be easily obtained.

Preferably in the aforementioned differential microphone unit according to the first aspect, the difference between the opening lengths of the second sound holes in the second direction on a surface of the sealing member opposite to the side of the microphone housing and the opening lengths of the first sound holes in the second direction on the major surface of the microphone housing is larger than the difference between the opening lengths of the second sound holes in the first direction on the surface of the sealing member opposite to the side of the microphone housing and the opening lengths of the first sound holes in the first direction on the major surface of the microphone housing. According to this structure, the second sound holes are stretched with respect to the first sound holes more widely along the second direction than along the first direction. In other words, a region having no directivity (a Null range), included in a region where the pair of second sound holes are opposed to each other in the first direction, can be easily narrowed due to the stretching of the second sound holes in the second direction.

Preferably in the aforementioned differential microphone unit according to the first aspect, a first distance from inner side surfaces of the first sound holes on a side where the pair of first sound holes are opposed to each other in the first direction up to inner side surfaces of the second sound holes communicating with the first sound holes is smaller than a second distance from inner side surfaces of the first sound holes on a side opposite to the side where the pair of first sound holes are opposed to each other up to the inner side surfaces of the second sound holes communicating with the first sound holes. According to this structure, the centers of the sound holes can be changed in directions separating from each other along the first direction when sound hole forming regions are switched from the first sound holes to the second holes, whereby the distance between the second sound holes in the first direction can be inhibited from decreasing also in a case of forming second sound holes whose lengths are larger than those of the first sound holes. As a result, the distance between the sound holes can be enlarged to a proper distance, whereby an SNR (signal-to-noise ratio) can be improved by improving the sensitivity of the differential microphone unit.

Preferably in this case, the inner side surfaces of the first sound holes on the side where the pair of first sound holes are opposed to each other in the first direction and the inner side surfaces of the second sound holes communicating with the first sound holes are arranged on the same plane. According to this structure, no first distance is so provided that the distance between the pairs of sound holes along the first direction can be reduced, whereby the size of the differential microphone unit can be further inhibited from increasing.

Preferably in the aforementioned structure in which the first distance is smaller than the second distance, the differential microphone unit is so formed that the central positions of the first sound holes in the first direction and the central positions of the second sound holes communicating with the first sound holes in the first direction do not overlap with each other in a plan view, and is so formed that the central positions of the first sound holes in the second direction and the central positions of the second sound holes communicating with the first sound holes in the second direction overlap with each other in a plan view. According to this structure, the opening shapes of the sound holes formed by the first sound holes and the second sound holes can be constituted to have substantially symmetrical shapes in the second direction. As a result of this, a range (sensitivity range) of directivity having a substantially symmetrical shape in the second direction with reference to the center of the differential microphone unit can be obtained in a state where the SNR (signal-to-noise ratio) is improved.

Preferably in the aforementioned differential microphone unit according to the first aspect, the second sound holes have inner side surfaces so inclined that opening lengths increase from the surface of the sealing member on the side of the microphone housing toward a surface opposite to the side of the microphone housing at least in the second direction. According to this structure, the opening lengths of the second sound holes of the sealing member on the side of the first sound holes (the side of the microphone housing) can be reduced, whereby the opening lengths of the second sound holes on the side of the first sound holes can be approximated to the lengths of the first sound holes. Thus, the lengths of discontinuous portions (step portions) resulting from the difference between the opening lengths of the first sound holes and the second sound holes can be inhibited from increasing on connected portions between the first sound holes and the second sound holes, whereby a sound collecting state of the differential microphone unit can be improved.

Preferably in this case, the opening lengths of the second sound holes on the surface of the sealing member on the side of the microphone housing are identical to the opening lengths of the first sound holes of the microphone housing. According to this structure, the inner side surfaces of the second sound holes of the sealing member form inclined surfaces along the thickness direction of the sealing member from starting points of edge portions of the first sound holes on the side in contact with the sealing member, whereby no step portions (discontinuous portions) can be formed on the connected portions between the first sound holes and the second sound holes, and the sound collecting state of the differential microphone unit can be improved as a result.

Preferably in the aforementioned differential microphone unit according to the first aspect, the sealing member is so formed that the opening lengths of the respective ones of the pair of second holes on the surface of the sealing member opposite to the side of the microphone housing are larger than opening lengths of the first sound holes in the first direction on the major surface of the microphone housing in the first direction. According to this structure, the second sound holes having larger opening lengths than the first sound holes of the microphone housing not only in the second direction but also in the first direction are formed on the sealing member, whereby the sound holes so spread that the range of the directivity of the differential microphone unit can be extended.

Preferably in the aforementioned differential microphone unit according to the first aspect, the sealing member is arranged to seal a space between a back surface side of a product housing, having a pair of third sound holes, in which a microphone is stored and the microphone housing, and the respective ones of the pair of second sound holes are formed to communicate with the respective ones of the pair of third sound holes provided on the product housing. According to this structure, the differential microphone unit can be made to reliably collect external sounds through the pair of third sound holes of the product housing in a state where the range of the directivity extends.

Preferably in this case, the second sound holes have inner side surfaces so inclined that opening lengths increase from the surface of the sealing member on the side of the microphone housing toward the surface opposite to the side of the microphone housing at least in the second direction, and the opening lengths of the second sound holes on a surface of the sealing member on the side of the product housing are identical to the opening lengths of the third sound holes of the product housing. According to this structure, the inner side surfaces of the third sound holes of the product housing extend along the thickness direction of the product housing from starting points of edge portions of the second sound holes on the side in contact with the sealing member, whereby no step portions (discontinuous portions) can be formed on connected portions between the second sound holes and the third sound holes, and the sound collecting state of the differential microphone unit can be improved as a result.

Preferably in the aforementioned differential microphone unit according to the first aspect, the vibrating portion is arranged in the microphone housing on the side where the pair of first sound holes are opposed to each other in the first direction. According to this structure, a sound path can be formed by easily reducing the difference between the path length of a sound reaching the vibrating portion from one sound hole and the path length of a sound reaching the vibrating portion from the other sound hole, unlike a case where the vibrating portion is arranged in the microphone housing of a region other than the region where the pair of first sound holes are opposed to each other.

Preferably in this case, central positions of the respective ones of the pair of first sound holes are arranged along the first direction in a plan view, and the vibrating portion is arranged on a straight line passing through the central positions of the respective ones of the pair of first sound holes. According to this structure, the distance from the central positions of the respective ones of the pair of first sound holes up to the vibrating portion can be minimally formed, unlike a case where the vibrating portion is arranged on a region other than the straight line. In other words, the path length of a sound reaching the vibrating portion from one sound hole and the path length of a sound reaching the vibrating portion from the other sound hole can be formed as short as possible. Thus, the path lengths so shorten that such a sound path can be formed that the difference caused between the path lengths is easily suppressed.

A mobile apparatus according to a second aspect of the present invention includes a differential microphone unit including a microphone housing in which a pair of first sound holes are provided on the same major surface, a vibrating portion arranged in the microphone housing for vibrating due to a difference between sound pressures arriving through the respective ones of the pair of first sound holes, and a sealing member, arranged on the major surface of the microphone housing, including a pair of second sound holes arranged to communicate with the respective ones of the pair of first sound holes, in which the sealing member is so formed that, in a second direction orthogonal to a first direction where the pair of first sound holes align with each other, the opening lengths of the respective ones of the pair of second sound holes on a surface of the sealing member opposite to a side in contact with the microphone housing are larger than the opening lengths of the first sound holes in the second direction on the major surface of the microphone housing, and a mobile apparatus housing in which the differential microphone unit is stored, while the sealing member is arranged to seal a space between a back surface side of the mobile apparatus housing, having a pair of third sound holes, in which a microphone is stored and the microphone housing, and the respective ones of the pair of second sound holes are formed to communicate with the respective ones of the pair of third sound holes provided on the mobile apparatus housing.

As hereinabove described, the mobile apparatus according to the second aspect of the present invention includes the microphone housing in which the pair of first sound holes are provided on the same major surface, the vibrating portion arranged in the microphone housing and the sealing member, arranged on the major surface of the microphone housing, including the pair of second sound holes arranged to communicate with the respective ones of the pair of first sound holes, whereby sound pressures (vibration of sound waves) input in the differential microphone unit can be made to reach the vibrating portion in the microphone housing through the respective ones of the pair of second sound holes (first sound holes) arranged on the same major surface of the microphone housing. In other words, the differential microphone unit can be constituted by easily substantially equalizing the path length (transmission distance (propagation time) of a sound wave) of a sound reaching the vibrating portion from one of the pair of sound holes and the path length (transmission distance (propagation time) of a sound wave) of a sound reaching the vibrating portion from the other one of the pair of sound holes to each other. Thus, the path lengths of sounds from the pair of sound holes provided on the same major surface to the vibrating portion can easily be substantially equalized to each other so that propagation time difference (phase difference) resulting from the difference between the respective path lengths can be reduced, unlike a case where the differential microphone unit is constituted in a state where the pair of sound holes are opened on surfaces (side surfaces) of the microphone housing that are different from each other, for example, whereby characteristics of the differential microphone unit in the mobile apparatus can be improved.

Further, the aforementioned mobile apparatus according to the second aspect includes the microphone housing, the vibrating portion, and the sealing member arranged on the major surface of the microphone housing, and the sealing member is so formed that, in the second direction orthogonal to the first direction where the pair of first sound holes align with each other, the opening lengths of the respective ones of the pair of second sound holes on the surface of the sealing member opposite to the side of the microphone housing are larger than the opening lengths of the first sound holes in the second direction on the major surface of the microphone housing, whereby the opening lengths of the second sound holes in the second direction are so larger than the opening lengths of the first sound holes that the range of directivity possessed by the differential microphone unit can be stretched and extended along the second direction. In this case, the ranges of directivity formed by the respective ones of the pair of second sound holes are both stretched along the second direction, whereby an angular range in which no sensitivity is obtained in the directivity (an angle at which the microphone is incapable of picking up sounds, referred to as a Null range) formed by the pair of second sound holes adjacent to each other along the first direction is more narrowed. As a result of this, a mobile apparatus so formed that the range (sensitivity range) of the directivity possessed by the differential microphone unit extends further can be obtained. In the aforementioned mobile apparatus according to the second aspect, the sealing member is so formed that the opening lengths of the respective ones of the pair of second sound holes on the surface of the sealing member opposite to the side in contact with the microphone housing are larger than the opening lengths of the first sound holes communicating with the respective ones of the pair of second sound holes in the second direction, whereby the range of the directivity possessed by the differential microphone unit can be further extended by adjusting the magnitudes (opening lengths) of the second sound holes on the side of the sealing member arranged on the major surface of the microphone housing without changing the magnitudes of the first sound holes on the side of the microphone housing. Thus, the magnitude of the microphone housing predominant over the size of the microphone unit may not be changed, whereby the size of the differential microphone unit stored in the mobile apparatus can be inhibited from increasing.

Preferably in the aforementioned mobile apparatus according to the second aspect, the mobile apparatus housing is so formed that the opening lengths of the respective ones of the pair of third sound holes are larger than the opening lengths of the respective ones of the pair of second sound holes on a surface of the sealing member in contact with the back surface of the mobile apparatus housing in the second direction. According to this structure, sounds outside the mobile apparatus can be reliably collected in a state of further extending the directivity possessed by the differential microphone unit by the pair of third sound holes of the mobile apparatus housing.

Preferably in the aforementioned mobile apparatus according to the second aspect, the differential microphone unit is stored in the mobile apparatus housing in a state of matching the first direction where the pair of first sound holes align with each other and the longitudinal direction of the mobile apparatus housing with each other. According to this structure, a region (Null range) having no directivity caused in the mobile apparatus can be effectively narrowed in the longitudinal direction (first direction) of the mobile apparatus. Thus, the flexibility of design at a time of assembling the differential microphone unit along the longitudinal direction can be improved.

MODES FOR CARRYING OUT THE INVENTION

Embodiments embodying the present invention are now described on the basis of the drawings.

First Embodiment

The structure of a mobile phone 200 including a differential microphone unit 100 according to a first embodiment of the present invention is described with reference to FIGS. 1 to 11. In the first embodiment, a case of applying the present invention to the mobile phone 200 including the differential microphone unit 100 as an example of the mobile apparatus according to the present invention is described.

The differential microphone unit 100 according to the present invention has two sound holes, and is formed to transmit the respective ones of sound pressures input in the two sound holes to the front surface and the back surface of a diaphragm (vibrating portion 11 described later). The diaphragm vibrates due to the difference between the sound pressures on its front and back surfaces, and has a function of outputting this vibration change as an electric signal.

This differential microphone 100 is designed to substantially equalize-propagation times of sounds from the respective ones of the two sound holes to the diaphragm to each other so that a delay difference reaches zero. The differential microphone unit 100 designed in this manner has such a characteristic that a sensitivity attenuating characteristic following a distance from a sound source is large. While an ordinary nondirectional microphone has an attenuation factor of about −20 dB/dec, a differential microphone has a large attenuation factor of about −40 dB/dec. In other words, the differential microphone unit 100 is formed to function as a noise-canceling microphone suppressing distant noise and capturing only nearby sounds. In order to make the differential microphone unit 100 exhibit performance as the noise-canceling microphone to the utmost, the differential microphone unit 100 must be formed to make sound transmission characteristics from the two sound holes to the diaphragm as equal as possible and portions from the respective ones of the two sound holes to the diaphragm must be brought into structures of propagating sounds in a well-balanced and efficient manner. If both propagation paths are unbalanced in a case where delay difference is caused between both propagation paths or a sound path of one propagation path is so narrow as compared with the other one that sound resistance increases, the differential microphone unit 100 cannot exhibit excellent performance as the aforementioned noise-canceling microphone.

Figure 1:
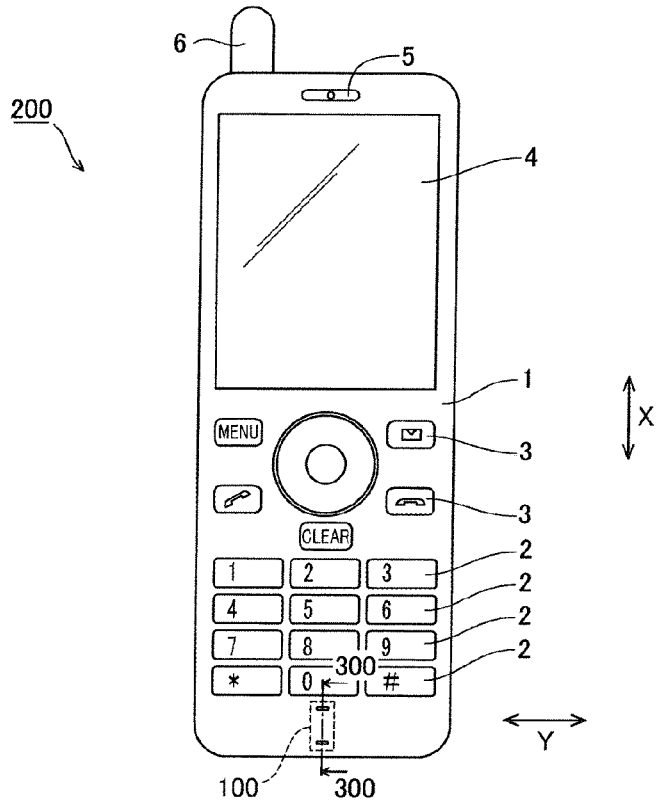
FIG. 1 A plan view showing the structure of a mobile phone including a differential microphone unit according to a first embodiment of the present invention.
Figure 2:
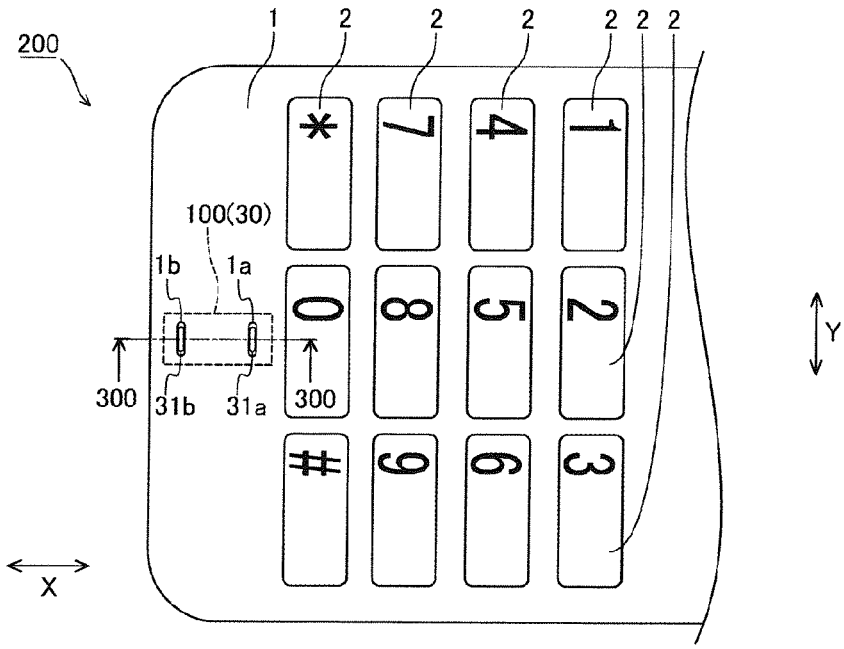
FIG. 2 A plan view partially enlarging the mobile phone including the differential microphone unit according to the first embodiment of the present invention.

The mobile phone 200 according to the first embodiment of the present invention is provided with a mobile phone housing portion 1, input key portions 2 consisting of "0 to 9" buttons, a "*" button and a "#" button, operating key portions 3 such as a menu button and a mail button, a display screen portion 4 consisting of a liquid crystal display, a speaker 5 outputting the voice of the other end of a phone call etc., an antenna 6 used in radio communication, and the differential microphone unit 100 for collecting the voice of a talker, etc., as shown in FIG. 1. The differential microphone unit 100 is arranged on the back surface side of the mobile phone housing portion 1 in a state of making the longitudinal direction of the differential microphone unit 100 along the vertical direction (direction X) of the mobile phone 200, as shown in FIGS. 1 and 2. The mobile phone housing portion 1 is an example of the "product housing" or the "mobile apparatus housing" in the present invention.

Figure 3:
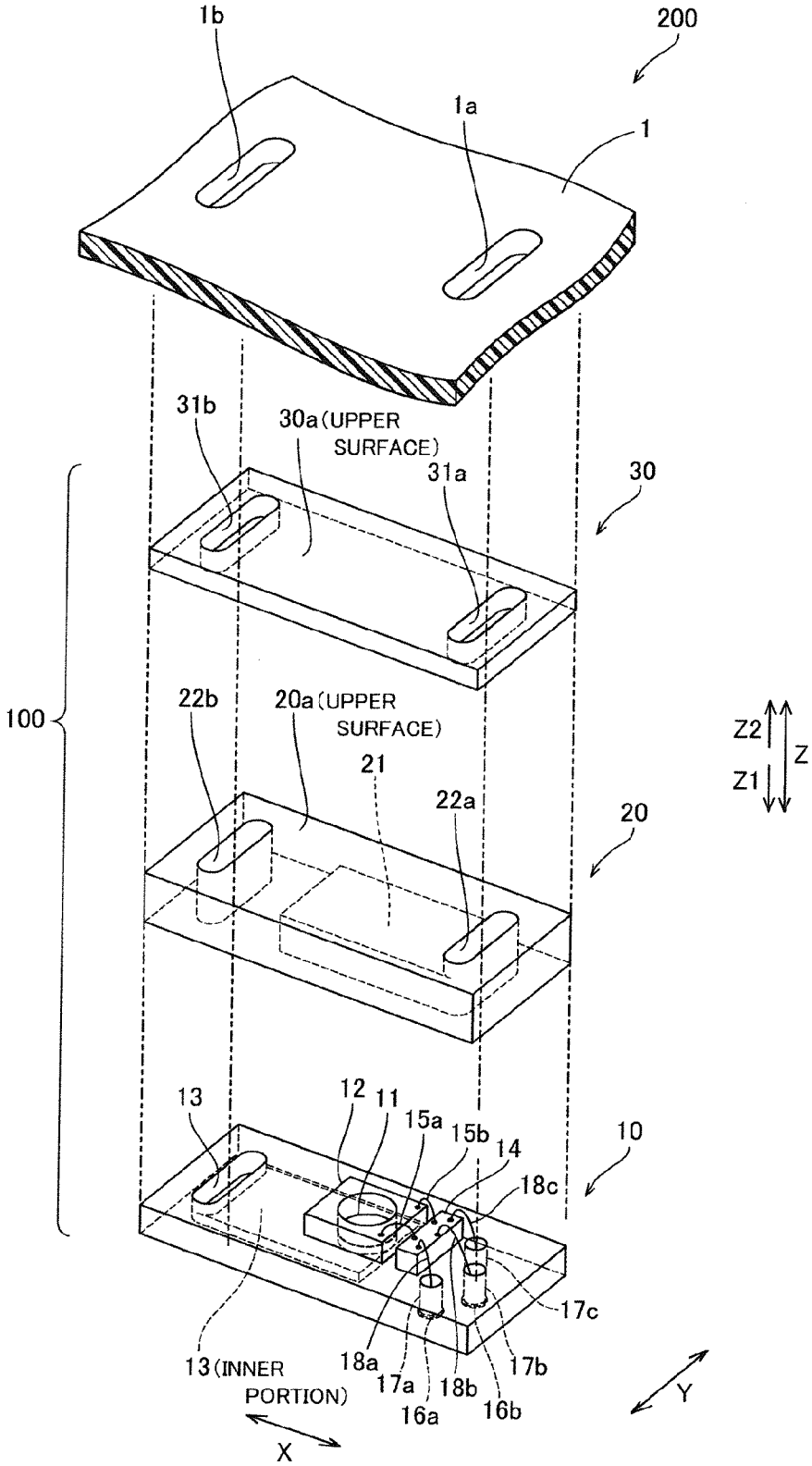
FIG. 3 An exploded perspective view showing a structure around the differential microphone unit of the mobile phone according to the first embodiment of the present invention.

The stricture of the differential microphone unit 100 is now described. In other words, the differential microphone unit 100 is constituted of a substrate 10 mounted with an MEMS chip 12 described later, etc., a cover portion 20 covering the substrate 10 from above (Z2 side) and a gasket 30 arranged on an upper surface 20*a* (surface on the Z2 side) of the cover portion 20, as shown in FIG. 3. The gasket 30 is provided for the purpose of improving a sealing property of the differential microphone unit 100 by being arranged in a clearance between the upper surface 20*a* of the cover portion 20 and the back surface (lower surface on a Z1 side) of the mobile phone housing portion 1. The substrate 10 and the cover portion 20 are examples of the "microphone housing" in the present invention, and the "microphone housing" in the present invention is constituted of the substrate 10 and the cover portion 20. The gasket 30 is an example of the "sealing member" in the present invention. The upper surface 20*a* is an example of the "major surface of the microphone housing" in the present invention.

Figure 4:
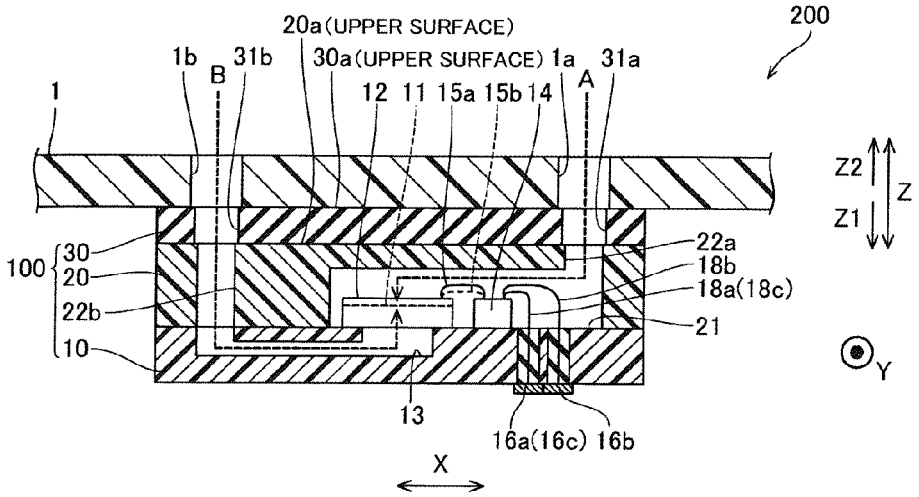
FIG. 4 A sectional view along the line 300-300 in FIG. 2.

The substrate 10 is made of an insulating material such as glass epoxy having a thickness of at least about 0.2 mm and not more than about 0.8 mm, and mounted with the MEMS (Micro Electro Mechanical System) chip 12 vibrating in response to the voice (sound pressure) of the talker input from outside the mobile phone housing, portion 1, as shown in FIG. 4. An electric signal input. IC 14 consisting of an integrated circuit formed to output an electric signal in response to vibration of the vibrating portion 11 of the MEMS chip 12 is arranged in the vicinity of the MEMS chip 12. As shown in FIG. 3, the MEMS chip 12 and the electric signal input IC 14 are electrically connected with each other by employing-wires 15*a* and 15*b* in a wire bonding system.

As shown in FIG. 3, the substrate 10 is provided with three, through-holes 17*a*, 17*b* and 17*c* passing through the same in the thickness direction (direction Z). Electrode portions 16*a*, 16*b* and 16*c* are formed on the back surface (Z1 side) of the substrate 10 correspondingly to the respective ones of the through-holes 17*a*, 17*b* and 17*c*. These electrode portions 16*a*, 16*b* and 16*c* are formed in order to perform supply of power to the electric signal input IC 14, output of the electric signal from the electric signal input IC 14 and GND connection (grounding). Further, wires 18*a*, 18*b* and 18*c* connected to the electric signal input IC 14 and the respective ones of the electrode portions 16*a*, 16*b* and 16*c* are provided. The wires 18*a*, 18*b* and 18*c* are embedded in the through-holes 17*a*, 17*b* and 17*c* passed correspondingly to the respective ones through unshown sealing compounds.

As shown in FIG. 4, a sound path 13 for making externally input sounds reach the lower surface (the surface on the Z1 side) of the vibrating portion 11 is formed in the substrate 10.

As shown in FIG. 4, the cover portion 20 is made of heat-resistant resin or the like having a thickness of at least about 0.4 mm and not more than about 1.0 mm, arranged at a prescribed distance from the peripheries of the MEMS chip 12 and the electric signal input IC 14, and fixed onto the upper surface (the surface on the Z2 side) of the substrate 10 by employing an unshown adhesive layer. A space formed around the MEMS chip 12 and the electric signal input IC 14 in the cover portion 20 is constituted as a sound path 21 for making the externally input sounds or the like reach the upper surface (the surface on the Z2 side) of the vibrating portion 11. A sound hole 22*a* passing through the upper surface 20*a* (the surface on the Z1 side) of the cover portion 20 to open outward is formed in a ceiling portion of the sound path 21. The cover portion 20 is provided with a sound hole 22*b* connected to the sound path 13 of the substrate 10 while passing through the cover portion 20 from the lower surface (the Z1 side) to the upper surface 20*a* (the Z2 side) in the thickness direction (the direction Z). The sound holes 22*a* and 22*b* are formed to align with each other on the upper surface 20*a* at a prescribed distance along the direction X. The sound holes 22*a* and 22*b* are examples of the "first sound holes" in the present invention, and the direction X is an example of the "first direction" in the present invention.

Figure 6:
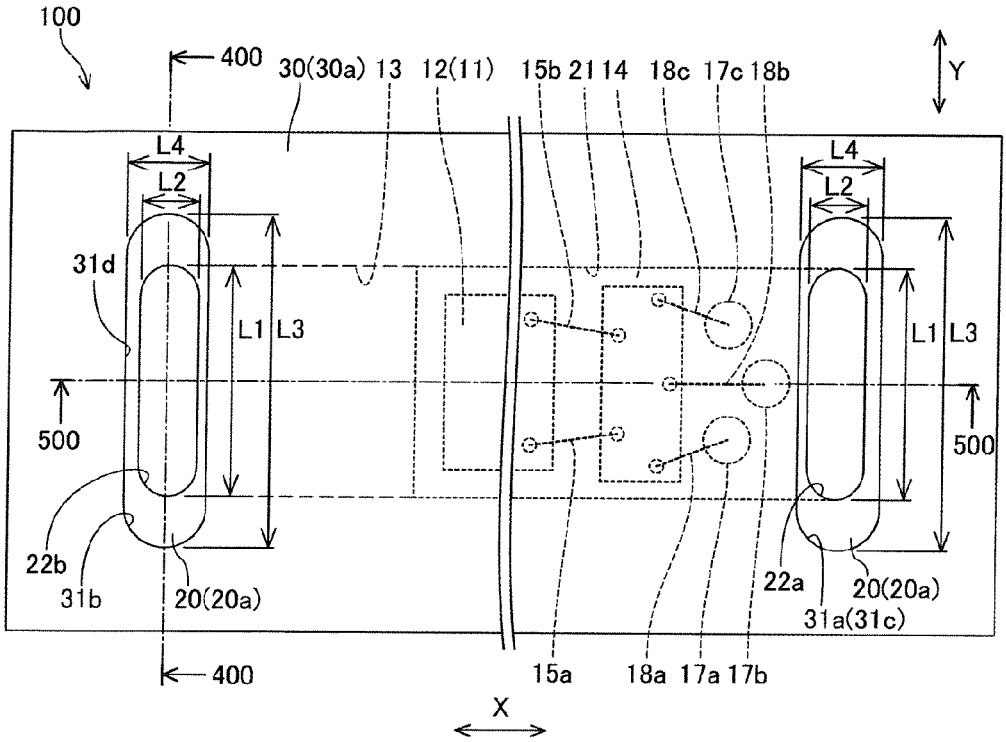
FIG. 6 A plan view showing the differential microphone unit of the mobile phone according to the first embodiment of the present invention.

According to the first embodiment, the vibrating portion 11 is arranged in the MEMS chip 12 arranged on a region of a side where the sound hole 22*a* and the sound hole 22*b* are opposed to each other in the direction X, as shown in FIG. 6. Further, the vibrating portion 11 is arranged on a straight line (line 500-500) passing through a central position of the sound hole 22*a* and a central position of the sound hole 22*b*. As shown in FIG. 1, the differential microphone unit 100 is stored in the mobile phone housing portion 1 in a state of matching the direction X where the sound holes 22*a* and 22*b* align with each other and the longitudinal direction (direction X) of the mobile phone housing portion 1 with each other.

The gasket 30 is made of an elastically deformable material (a rubber member or the like) having a thickness of at least about 0.2 mm and not more than about 3 mm in a natural state, and arranged on the upper surface 20*a* (Z2 side) of the cover portion 20, as shown in FIGS. 3 and 4. In the gasket 30, sound holes 31*a* and 31*b* are formed on positions corresponding to the respective ones of the sound hole 22*a* and the sound hole 22*b* of the cover portion 20 respectively. The sound holes 31*a* and 31*b* are examples of the "second sound holes" in the present invention.

The mobile phone housing portion 1 is made of heat-resistant resin or the like having a thickness of at least about 0.8 mm and not more than about 1.2 mm, and is arranged in contact with the upper surface (the surface on the Z2 side) of the gasket 30, as shown in FIGS. 3 and 4. In the mobile phone housing portion 1, sound holes 1*a* and 1*b* are formed at positions corresponding to the respective ones of the sound holes 31*a* and 31*b* of the gasket 30 respectively. The sound holes 1*a* and 1*b* are examples of the "third sound holes" in the present invention.

According to the first embodiment, the aforementioned differential microphone unit 100 is arranged on the back surface side of the mobile phone housing portion 1, to be so formed that the voice of the talker reaches the upper surface (the surface on the Z2 side) of the vibrating portion 11 while passing through the sound holes 1*a*, 31*a* and 22*a* and the sound path 21 in this order (as shown by a path A in FIG. 4), and reaches the lower surface (the surface on the Z1 side) of the vibrating portion 11 while passing through the sound holes 1*b*, 31*b* and 22*b* and the sound path 13 in this order (as shown by path B in FIG. 4). Thus, the differential microphone unit 100 is so formed that the MEMS chip 12 detects the voice of the talker by utilizing that the vibrating portion 11 vibrates in response to the difference between sound pressures (strength of sound waves) arriving from both paths (paths A and B). The differential microphone unit 100 is so formed that the vibration of the vibrating portion 11 detected by the MEMS chip 12 is converted to an electric signal by the electric signal input IC 14, which signal is thereafter output into an unshown control circuit portion provided on the mobile phone 200 so that the electric signal (voice signal) is amplified and thereafter transmitted to a mobile phone or the like at the other end.

Figure 5:
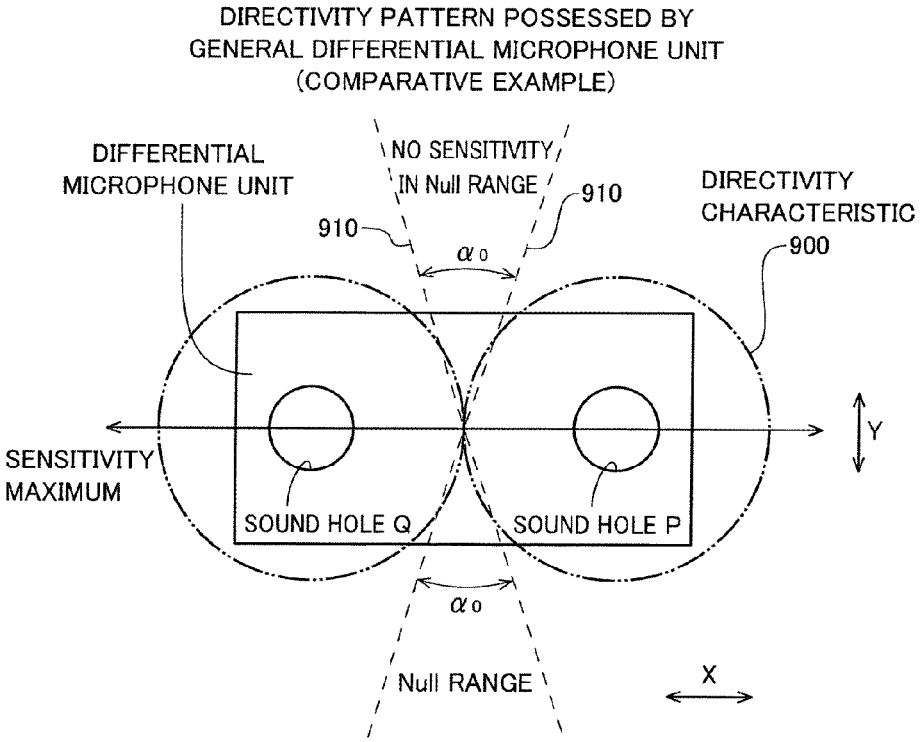
FIG. 5 A schematic diagram showing the directivity possessed by a general differential microphone unit.

A general differential microphone unit has the directivity shown in the comparative example of FIG. 5. In a case where a pair of sound holes P and Q having substantially circular shapes in plan view are formed at a prescribed distance along a direction X, for example, this differential microphone unit has a substantially figure-eight directivity pattern (the range of directivity is shown with a two-dot chain line 900). Further, the general differential microphone unit is so formed that sensitivity with respect to a straight line direction (direction X) connecting the centers of the respective sound holes with each other is the maximum and sensitivity minimizes (no sensitivity) in a direction (direction Y) orthogonal to this direction (direction X). Referring to FIG. 5, an angular range (in a region of an angle $\alpha_0$ held between two broken lines 910 intersecting with each other in the figure) out of the substantially figure-eight directivity is a direction not in the least having sensitivity to sounds, and is known as the so-called "Null range". In a case of employing the differential microphone unit, it is made possible that the range of the directivity relatively spreads (to collect sounds in a wider range) by narrowing this Null range.

According to the first embodiment, the sound holes 22*a* and 22*b* of the cover portion 20 both have slot shapes (track shapes) stretched along the lateral direction (direction Y) of the mobile phone 200 (see FIG. 1) in a plan view, as shown in FIG. 3. The sound holes 31*a* and 31*b* of the gasket 30 are also formed to be arranged above (Z2 side) the respective ones of the sound holes 22*a* and 22*b* in states both having slot shapes (track shapes) extending in the direction Y. Further, the sound holes 1*a* and 1*b* of the mobile phone housing portion 1 in contact with the upper surface 30*a* of the gasket 30 are also formed to be arranged above (Z2 side) the respective ones of the sound holes 31*a* an 31*b* in states both having slot shapes (track shapes) extending in the direction Y. Thus, end portions of the respective sound holes in the direction Y are constituted of smooth curves (curved surfaces). The upper surface 30*a* is an example of the "surface opposite to the side of the microphone housing" in the present invention. The direction Y is an example of the "second direction" in the present invention.

In a case of planarly viewing the differential microphone unit 100, therefore, the sound holes 22*a* and 22*b* of the cover portion 20 are formed as slot shapes whose opening lengths L1 (about 2 mm) in the direction Y are larger (L1>L2) than opening lengths L2 (about 0.5 mm) in the direction X respectively, as shown in FIG. 6. The central position of the sound hole 22*a* and the central position of the sound hole 22*b* are arranged along the line 500-500. Thus, end portions (end portions on the respective ones of the upper side and the lower side in the plane of FIG. 6) of the sound holes 22*a* and 22*b* in the direction Y are aligned along the direction X. Further, the sound holes 31*a* and 31*b* of the gasket 30 arranged above (front side in the plane of the figure) the respective ones of the sound holes 22*a* and 22*b* are formed as slot shapes whose opening lengths L3 (about 3 mm) in the direction Y are larger (L3>L4) than opening lengths L4 (about 0.6 mm) in the direction X respectively. While the mobile phone housing portion 1 (see FIG. 3) having the sound holes 1*a* and 1*b* is arranged on the front side of the plane of the figure in FIG. 6, illustration of the mobile phone housing portion 1 is omitted in FIG. 6 for the convenience of description.

Figure 7:
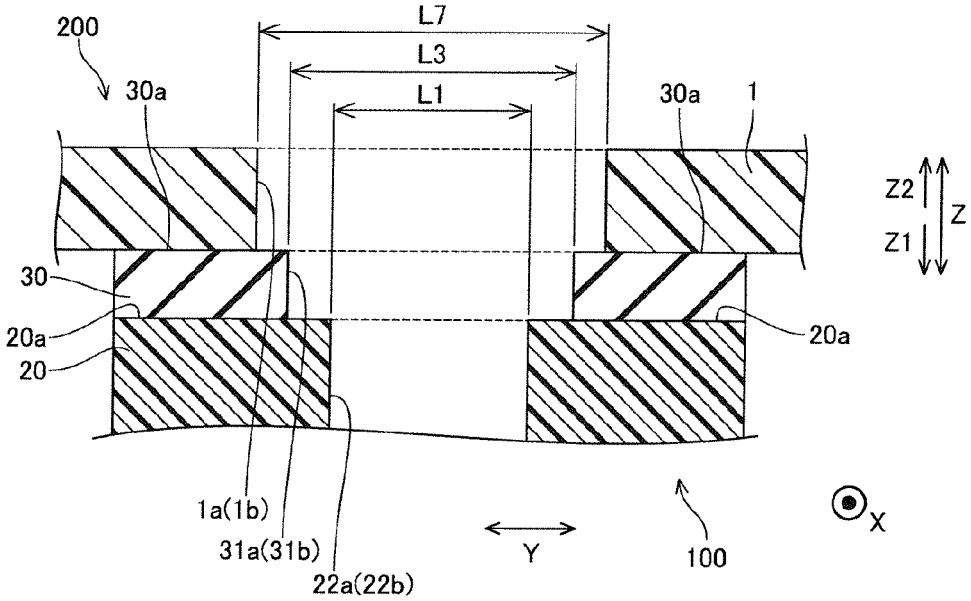
FIG. 7 An enlarged sectional view along the line 400-400 in FIG. 6.

Describing the relation between the magnitudes of the respective sound holes provided on the cover portion 20 and the gasket 30 in more detail, the differential microphone unit 100 is so formed that the opening length L3 of the sound hole 31*a* (31*b*) on the surface (upper surface 30*a* on the side (the Z2 side) in contact with the mobile phone housing portion 1) of the gasket 30 opposite to the cover portion 20 is larger (L3>L1) than the opening length L1 of the sound hole 22*a* (22*b*) on the upper surface 20*a* of the cover portion 20 on the side (the Z2 side) in contact with the gasket 30 as shown in FIG. 7, in a case of viewing the differential microphone unit 100 in a section (section along the direction Y) along the line 400-400 in FIG. 6.

Figure 8:
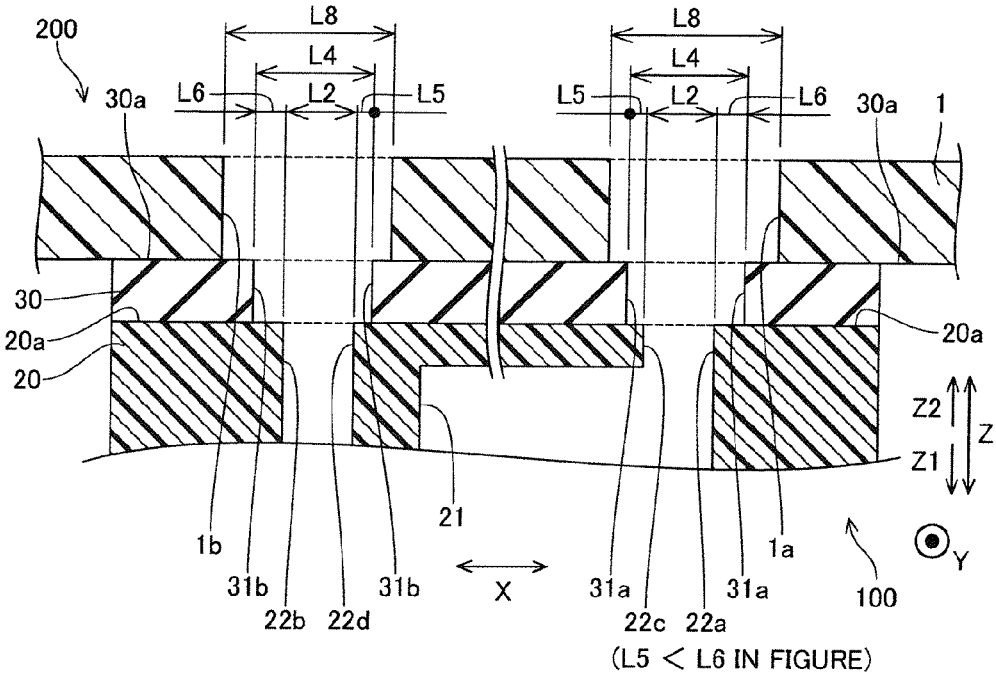
FIG. 8 An enlarged sectional view along the line 500-500 in FIG. 6.

Further, the differential microphone unit 100 is so formed that the opening length L4 of the sound hole 31*a* (31*b*) on the upper surface 30*a* (the surface on the Z2 side) of the gasket 30 opposite to the side of the cover portion 20 is larger (L4>L2)

than the opening length L2 of the sound hole 22*a* (22*b*) on the upper surface 20*a* (the surface on the Z2 side) of the cover portion 20 on the side of the gasket 30 as shown in FIG. 8, in a case of viewing the differential microphone unit 100 in a section (section along the direction X) alone the line 500-500 in FIG. 6.

As shown in FIG. 6, the sound hole 22*a* is arranged in a region surrounded by an inner side surface 31*c* of the sound hole 31*a* arranged on an upper side (the front side in the plane of the figure) in a plan view, while the sound hole 22*b* is arranged in a region surrounded by an inner side surface 31*d* of the sound hole 31.*b* arranged on the upper side (the front side in the plane of the figure) in a plan view. Thus, the differential microphone unit 100 is so formed that the sound hole 22*a* is completely exposed on the inner side of the sound hole 31*a* while the sound hole 22*b* is completely exposed on the inner side of the sound hole 31*b*.

Further, the differential microphone unit 100 is so formed that the difference (the length corresponding to L3−L1 in FIG. 7) between the opening length L3 of the sound hole 31*a* (31*b*) on the upper surface 30*a* (the surface on the Z2 side) of the gasket 30 opposite to the side of the cover portion 20 and the opening length L1 of the sound hole 22*a* (22*b*) on the upper surface 20*a* (the surface on the Z2 side) of the cover portion 20 on the side of the gasket 30 is larger (L3−L1>L4−L2) than the difference (the length corresponding to L4−L2 in FIG. 8) between the opening length L4 of the sound hole 31*a* (31*b*) on the upper surface 30*a* (the surface on the Z2 side) of the gasket 30 opposite to the side of the cover portion 20 and the opening length L2 of the sound hole 22*a* (22*b*) on the upper surface 20*a* (the surface on the Z2 side) of the cover portion 20 on the side of the gasket 30. In other words, the differential microphone unit 100 is so formed that the sound hole 31*a* (31*b*) of the gasket 30 opens more widely than the sound hole 22*a* (22*b*) of the cover portion 20 with respect to the direction Y than with respect to the direction X, as shown in FIGS. 6 to 8.

As shown in FIG. 8, the differential microphone unit 100 is so formed that the distance L5 from the inner side surface 22*c* (22*d*) of the sound hole 22*a* (22*b*) on the side where the sound hole 22*a* and the sound hole 22*b* are opposed to each other in the direction X up to the inner side surface 31*c* (31*d*) of the sound hole 31*a* (31*b*) arranged on the upper side (the Z2 side) is smaller (L5<L6) than the distance L6 from the inner side surface 22*c* (22*d*) of the sound hole 22*a* (22*b*) on the side opposite to the side where the sound hole 22*a* and the sound hole 22*b* are opposed to each other up to the inner side surface 31*c* (31*d*) of the sound hole 31*a* (31*b*) arranged on the upper side (the Z2 side). The distance L5 and the distance L6 are examples of the "first distance" and the "second distance" in the present invention, respectively. According to the first embodiment, therefore, the differential microphone unit 100 is so formed that the central position of the sound hole 22*a* (22*b*) in the direction X and the central position of the sound hole 31*a* (31*b*) on the front side in the plane of the figure in the direction X do not overlap with each other (i.e., they deviate from each other in the direction X) in a plan view, as shown in FIG. 6. In other words, the central position of the sound hole 22*a* is brought slightly closer to the side (the right side in the plane of the figure) of the sound hole 22*b* than the central position of the sound hole 31*a*. Further, the central position of the sound hole 22*b* is brought slightly closer to the side (left side in the plane of the figure) of the sound hole 22*a* than the central position of the sound hole 31*b*. On the other hand, the differential microphone unit 100 is so formed that the central position of the sound hole 22*a* (22*b*) in the direction Y and the central position of the sound hole 31*a* (31*b*) in the direction Y overlap (coincide) with each other in a plan view.

Figure 9:
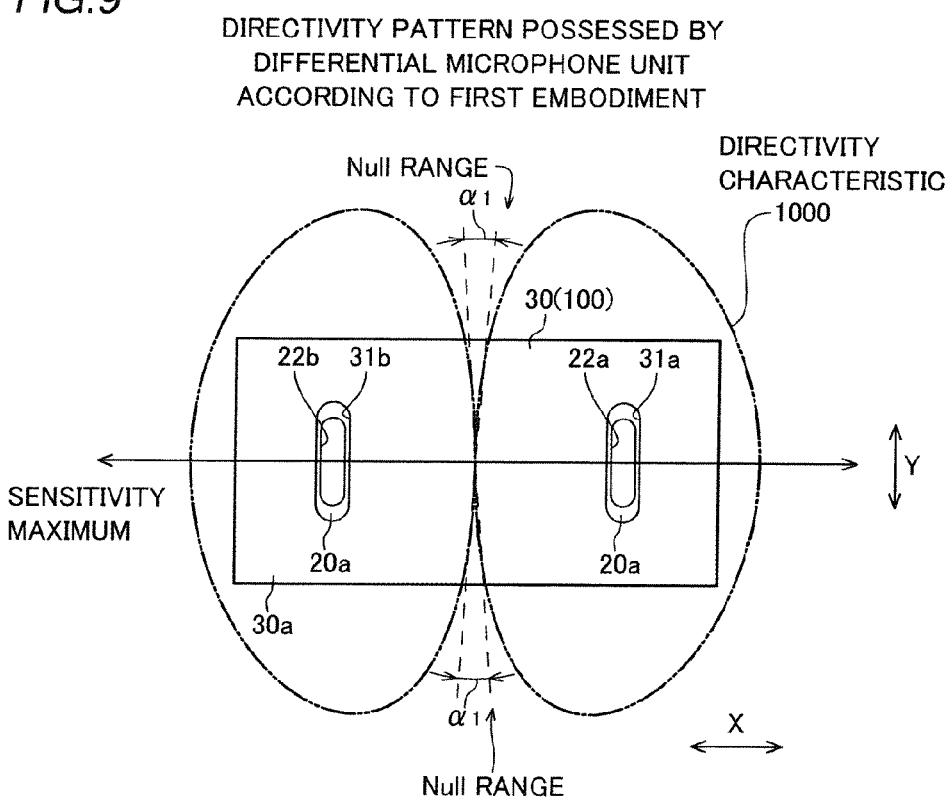
FIG. 9 A schematic diagram showing directivity possessed by the differential microphone unit of the mobile phone according to the first embodiment of the present invention.

According to the first embodiment, the sound holes having the aforementioned shapes are so formed that the differential microphone unit 100 is formed to have the directivity shown in FIG. 9. In other words, a directivity pattern (shown by a two-dot chain line 1000) shown by a substantially figure-eight shape is stretched along the direction Y in a case of comparing the same with the directivity possessed by the general differential microphone unit (see FIG. 5), whereby the differential microphone unit 100 is formed to be capable of more narrowing the Null range (the range shown by an angle $\alpha_1$ out of the substantially figure-eight directivity) than the Null range (range shown by the angle $\alpha_0$) in the case of FIG. 5. Thus, the differential microphone unit 100 is so formed that it becomes possible to collect sounds (i.e., to extend the range of the directivity) in a wider range than the general differential microphone unit (see FIG. 5). Further, the differential microphone unit 100 matches the direction X where the sound holes 22*a* and 22*b* align with each other and the longitudinal direction of the mobile phone housing portion 1 with each other in FIG. 1. Thus, it becomes possible to effectively narrow the aforementioned Null range in the longitudinal direction (the direction X) of the mobile phone 200.

Figure 10:
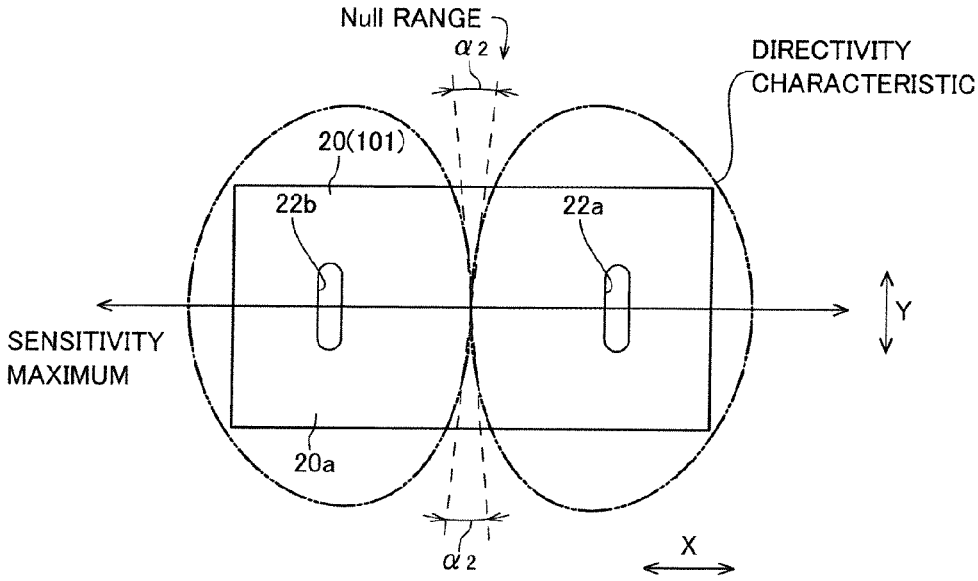
FIG. 10 A schematic diagram showing the directivity possessed by the differential microphone unit in a case where no gasket is provided on the differential microphone unit of the mobile phone according to the first embodiment of the present invention.

According to the first embodiment, the sound holes 31*a* and 31*b* of the gasket 30 open more widely than the sound holes 22*a* and 22*b*, respectively, of the cover portion 20 along the direction Y, whereby it is possible to more reduce (narrow) the Null range. In other words, in a case where no gasket 30 (see FIG. 9) is provided on a differential microphone unit 101 but only sound holes 22*a* and 22*b* open on an upper surface 20*a* of a cover portion 20 as shown in FIG. 10, for example, a Null range (a range shown by an angle $\alpha_2$) possessed by this differential microphone unit 101 is more narrowed than the Null range (the range shown by the angle $\alpha_1$) shown in FIG. 5 to some extent due to the slot shapes of the sound holes 22*a* and 22*b*. In the differential microphone unit 100 shown in the first embodiment, on the other hand, the slot-shaped sound holes 31*a* and 31*b* are formed also on the gasket 30 arranged on the cover portion 20 in addition to the sound holes 22*a* and 22*b* of the cover portion 20, whereby the opening lengths of the sound holes in the direction Y are so further stretched that the Null range (the range shown by the angle $\alpha_1$) possessed by the differential microphone unit 100 is further narrowed (angle $\alpha_1$<angle $\alpha_2$<angle $\alpha_0$) than the Null range (the range shown by the angle $\alpha_2$) possessed by the differential microphone unit 101 shown in FIG. 10, and hence the differential microphone unit 100 is so formed that it becomes possible to collect sounds (to more extend the range of the directivity) in a wider range.

In a case of viewing the mobile phone housing portion 1 in a section (a section along the direction Y) along the line 400-400 in FIG. 6, the mobile phone housing portion 1 is so formed that the opening length L7 of the sound hole 1*a* (1*b*) on the upper surface (the surface on the Z2 side) of the mobile phone housing portion 1 is larger (L7>L3) than the opening length. L3 of the sound hole 31*a* (31*b*) on the upper surface 30*a* of the gasket 30 on the side (the Z2 side) in contact with the mobile phone housing portion 1, as shown in FIG. 7. In a case of viewing the mobile phone housing portion 1 in a section (a section along the direction X) along the line 500-500 in FIG. 6, further, the mobile phone housing portion 1 is so formed that the opening length L8 of the sound hole 1*a* (1*b*) on the upper surface (the surface on the Z2 side) of the mobile phone housing portion 1 is larger (L8>L4) than the opening length L4 of the sound hole 31*a* (31*b*) on the surface of the gasket 30 on the side (the Z2 side) in contact with the mobile phone housing portion 1, as shown in FIG. 8.

Thus, the differential microphone unit 100 is formed to be capable of collecting the voice of the talker without damaging the directivity shown in FIG. 9 also in a state stored in the mobile phone 200 (see FIG. 2).

Figure 11:
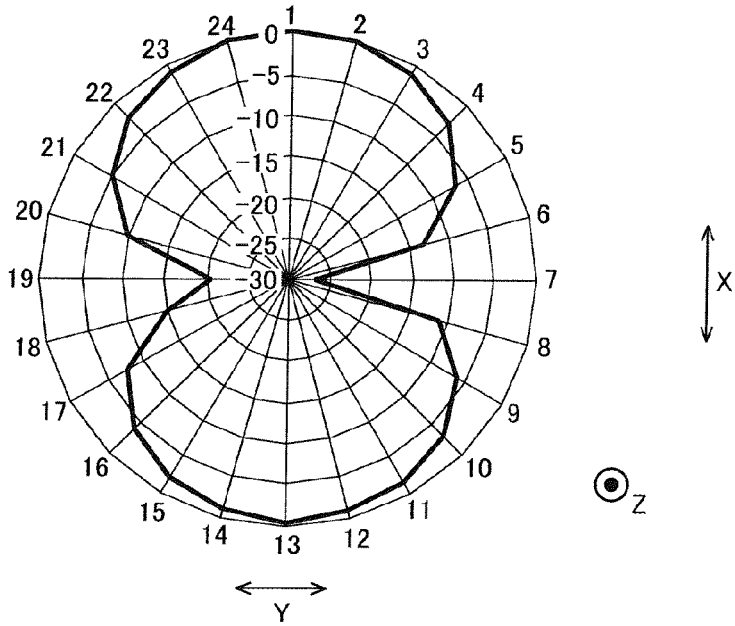
FIG. 11 A diagram showing the results of measuring directivity characteristics possessed by the differential microphone unit of the mobile phone according to the first embodiment of the present invention.

FIG. 11 shows exemplary results of measuring the directivity possessed by the aforementioned differential microphone unit 100. While results of measurement of directivity characteristics of the differential microphone unit 100 at 1 kHz are shown in FIG. 11, it has been confirmed that such directivity characteristics are obtained that upper and lower circular regions link with each other on a substantially central portion of a figure-eight shape in the figure. A direction X and a direction Y in FIG. 11 correspond to the direction X and the direction Y in FIG. 10, respectively. From these results, such an effect has been confirmable that the range of directivity along the direction Y is so stretched that the Null range is relatively narrowed (the range of the directivity is more extended) in the differential microphone unit 100 according to the first embodiment, unlike the directivity possessed by the general differential microphone unit shown in FIG. 5.

According to the first embodiment, as hereinabove described, the differential microphone unit 100 includes the cover portion 20 in which the sound holes 22*a* and 22*b* are provided on the same upper surface 20*a*, the vibrating portion 11 arranged in the cover portion 20, and the gasket 30, arranged on the upper surface 20*a* of the cover portion 20, including the sound holes 31*a* and 31*b* arranged to communicate with the respective ones of the sound holes 22*a* and 22*b*. Thus, sound pressures (vibration of sound waves) input in the differential microphone unit 100 can be made to reach the vibrating portion 11 in the cover portion 20 through the respective ones of the sound hole 31*a* (22*a*) and the sound hole 31*b* (22*b*) arranged on the same upper surface 20*a* of the cover portion 20. In other words, the differential microphone unit 100 in which the difference is inhibited from increasing can be formed by substantially equalizing the length (the transmission distance (propagation time) of the sound wave) of the path A (see FIG. 4) from the entrance of the sound hole 31*a* (22*a*) to the upper surface of the vibrating portion 11 and the length (the transmission distance (propagation time) of the sound wave) of the path B (see FIG. 4) from the entrance of the sound hole 31*b* (22*b*) to the lower surface of the vibrating portion 11 to each other. Thus, propagation time difference (phase difference) resulting from the difference between the respective path lengths (the difference between the path A and the path B) can be reduced, whereby omnidirectional noise-suppressing performance possessed by the differential microphone is improved white a noise-suppressible frequency band is widened, and characteristics of the differential microphone unit 100 can be improved.

According to the first embodiment, the differential microphone unit 100 includes the cover portion 20, the vibrating portion 11, and the gasket 30 arranged on the upper surface 20*a* of the cover portion 20, and the opening lengths L3 of the respective ones of the sound holes 31*a* and 31*b* on the upper surface 30*a* of the gasket 30 opposite to the side of the cover portion 20 are larger (L3>L1) than the opening lengths L1 of the respective ones of the sound holes 22*a* and 22*b* in the direction Y on the upper surface 20*a* of the cover portion 20 on the side of the gasket 30 in the direction Y orthogonal to the direction X where the sound holes 22*a* and 22*b* align with each other. Thus, the range of the directivity (the characteristic showing which angled sounds are to be clearly captured with excellent sensitivity as viewed from centers of the sound holes) possessed by the differential microphone unit 100 can be more extended through the mutual positional relation between the sound holes 31*a* and 31*b* overlapped above the sound holes 22*a* and 22*b* aligning with each other in the direction X and the shapes (opening lengths) of the sound holes. More specifically, L3>L1 in the case of arranging the gasket 30 provided with the sound holes 31*a* and 31*b* having the opening lengths L3 larger than the opening lengths L1 of the sound holes 22*a* and 22*b* in the direction Y on the upper surface 20*a* of the cover portion 20 in the state making the sound hole 22*a* (22*b*) and the sound hole 31*a* (31*b*) communicate with each other, whereby it becomes possible (see FIG. 9) to stretch and extend the range of the directivity possessed by the differential microphone unit 100 along the direction Y as compared with the range (see FIG. 10) of the directivity in the case where the differential microphone unit 101 is constituted of only the sound holes 22*a* and 22*b* of the cover portion 20, for example. In this case, the ranges of directivity formed by the respective ones of the sound holes 31*a* and 31*b* are both stretched along the direction Y, whereby the angular range in which no sensitivity is obtained in the directivity (the Null range) formed by the sound holes 31*a* and 31*b* adjacent to each other along the direction X is made more narrow. As a result, the range (sensitivity range) of the directivity possessed by the differential microphone unit 100 can be more extended.

According to the first embodiment, the opening lengths L3 of the respective ones of the sound holes 31*a* and 31*b* on the upper surface 30*a* of the gasket 30 opposite to the side in contact with the cover portion 20 are larger than the opening lengths L1 of the respective ones of the sound holes 22*a* and 22*b* communicating with the respective ones of the sound holes 31*a* and 31*b* in the direction Y. Thus, the range of the directivity possessed by the differential microphone unit 100 can be more extended by adjusting the planar magnitude (the opening length L3) of the sound hole 31*a* (31*b*) on the side of the gasket 30 arranged on the upper surface 20*a* of the cover portion 20 without changing the planar magnitude of the sound hole 22*a* (22*b*) on the side of the cover portion 20. Thus, the magnitude of the cover portion 20 predominant over the size of the differential microphone unit 100 may not be changed, whereby the size of the differential microphone unit 100 can be inhibited from increasing.

According to the first embodiment, the sound hole 22*a* (22*b*) is arranged in the region surrounded by the inner side surface 31*c* (31*d*) of the sound hole 31*a* (31*b*) communicating with the sound hole 22*a* (22*b*) in a plan view. Thus, the sound hole 22*a* (22*b*) of the cover portion 20 is arranged on the region inside the sound hole 31*a* (31*b*) of the gasket 30 in the exposed state in a case where the cover portion 20 is viewed from the side of the gasket 30, whereby such a state is avoided that the sound hole 22*a* (22*b*) is partially ensconced by the sound hole 31*a* (31*b*). In other words, the sound hole 22*a* (22*b*) is not obstructed by the sound hole 31*a* (31*b*), whereby the directivity (see FIG. 9) possessed by the differential microphone unit 100 can be retained to have a normal range.

According to the first embodiment, the central position of the sound hole 22*a* and the central position of the sound hole 22*b* are arranged along the direction X in a plan view. Thus, the directivity characteristic 1000 (see FIG. 9) having a substantially symmetrical shape in the direction X with reference to the center of the differential microphone unit 100 can be obtained. As a result of this, the angular range in which no sensitivity is obtained in the directivity (the Null range) can be symmetrically narrowed on both sides in the direction Y with reference to the center of the differential microphone unit 100.

According to the first embodiment, the differential microphone unit 100 is so formed that the opening length L1 of the sound hole 22*a* (22*b*) in the direction Y is larger (L1>L2) than the opening length L2 of the sound hole 22*a* (22*b*) in the direction X, while the opening length L3 of the sound hole 31*a* (31*b*) in the direction Y is larger (L3>L4) than the opening length L4 of the sound hole 31*a* (31*b*) in the direction X. Thus, the opening lengths of the sound hole 22*a* (22*b*) and the sound hole 31*a* (31*b*) in the direction Y are larger than the opening lengths in the direction X as compared with the case (see FIG. 5) of forming the sound hole 22*a* (22*b*) and the sound hole 31*a* (31*b*) in such circular shapes that the opening lengths of the respective ones in the direction X and the direction Y are both substantially equal to each other, so that the range of the directivity possessed by the differential microphone unit 100 can be preferentially stretched (see FIG. 10) in the direction Y, whereby the range of the directivity possessed by the differential microphone unit 100 can be easily extended, as described above.

According to the first embodiment, the sound hole 22*a* (22*b*) and the sound hole 31*a* (31*b*) both have the slot shapes extending along the direction Y. Thus, the sound hole 22*a* (22*b*) and the sound hole 31*a* (31*b*) are formed in the slot shapes extending along the direction Y, unlike a case where the same have rectangular shapes or triangular shapes including corner portions, whereby the range of the directivity possessed by the differential microphone unit 100 can be properly ensured.

According to the first embodiment, the aforementioned slot shapes are track shapes. Thus, the end portions of the sound hole 22*a* (22*b*) and the sound hole 31*a* (31*b*) in the direction Y can be constituted of smooth curves (curved surfaces), whereby the directivity characteristics having isotropy shown in FIG. 11 can be easily obtained.

According to the first embodiment, the difference (L3−L1) between the opening length L3 of the sound hole 31*a* (31*b*) on the upper surface 30*a* of the gasket 30 opposite to the side of the cover portion 20 in the direction Y and the opening length L1 of the sound hole 22*a* (22*b*) on the upper surface 20*a* of the cover portion 20 on the side of the gasket 30 in the direction Y is larger (L3−L1>L4−L2) than the difference (L4−L2) between the opening length L4 of the sound hole 31*a* (31*b*) on the upper surface 30*a* of the gasket 30 opposite to the side of the cover portion 20 in the direction X and the opening length L2 of the sound hole 22*a* (22*b*) on the upper surface 20*a* of the cover portion 20 on the side of the gasket 30 in the direction X. Thus, the sound hole 31*a* (31*b*) is stretched with respect to the sound hole 22*a* (22*b*) more widely along the direction Y than along the direction X. Thus, a region having no directivity (the Null range shown in FIG. 10), included in the region where the sound holes 31*a* and 31*b* are opposed to each other in the direction X, can be easily narrowed due to the stretching of the sound hole 31*a* (31*b*) in the direction Y.

According to the first embodiment, the distance L5 from the inner side surface 22*c* (22*d*) on the side where the sound holes 22*a* and 22*b* are opposed to each other in the direction X up to the inner side surface 31*c* (31*d*) of the sound hole 31*a* (31*b*) communicating with the sound hole 22*a* (22*b*) is smaller (L5<L6) than the distance L6 from the inner side surface 22*c* (22*d*) on the side opposite to the side where the sound holes 22*a* and 22*b* are opposed to each other up to the inner side surface 31*c* (31*d*) of the sound hole 31*a*. Thus, the centers of the sound holes can be changed in directions separating from each other along the direction X when the regions provided with the sound holes are switched from the sound hole 22*a* (22*b*) to the sound hole 31*a* (31*b*) along the direction Z, whereby the distance between the sound holes 31*a* and 31*b* in the direction X can be inhibited from decreasing also in the case of forming the sound hole 31*a* (31*b*) whose length in the direction Y is larger than that of the sound hole 22*a* (22*b*). As a result, the distance between the sound holes can be enlarged to a proper distance, whereby an SNR (signal-to-noise ratio) can be improved by improving the sensitivity of the differential microphone unit 100.

According to the first embodiment, the differential microphone unit 100 is so formed that the central position of the sound hole 22*a* (22*b*) in the direction X and the central position of the sound hole 31*a* (31*b*) in the direction X do not overlap with each other in a plan view, and is so formed that the central position of the sound hole 22*a* (22*b*) in the direction Y and the central position of the sound hole 31*a* (31*b*) in the direction Y overlap with each other in a plan view. Thus, opening shapes of sound holes formed by the sound hole 22*a* (22*b*) and the sound hole 31*a* (31*b*) can be formed to have substantially symmetrical shapes on both sides in the direction Y. As a result of this, the directivity characteristic 1000 (see FIG. 9) having a substantially symmetrical shape in the direction Y with reference to the center of the differential microphone unit 100 can be obtained in a state where the SNR (signal-to-noise ratio) is improved.

According to the first embodiment, the gasket 30 is so formed that, in the direction X, the opening lengths L4 of the respective ones of the sound holes 31*a* and 31*b* on the upper surface 30*a* of the gasket 30 opposite to the side of the cover portion 20 are larger (L4>L2) than the opening lengths L2 of the sound holes 22*a* and 22*b* on the upper surface 20*a* of the cover portion 20 on the side of the gasket 30 in the direction X. Thus, the sound hole 31*a* (31*b*) having the opening length larger than that of the sound hole 22*a* (22*b*) not only in the direction Y but also in the direction X is formed on the gasket 30, whereby the sound hole so spreads that the range of the directivity of the differential microphone unit 100 can be extended.

According to the first embodiment, the gasket 30 is arranged to seal the space between the back surface side (the Z1 side) of the mobile phone housing portion 1, having the sound holes 1*a* and 1*b*, in which the differential microphone unit 100 is stored and the cover portion 20, and is so formed that the respective ones of the sound holes 31*a* and 31*b* communicate with the respective ones of the sound holes 1*a* and 1*b* provided on the mobile phone housing portion 1. Thus, the differential microphone unit 100 can be made to reliably collect external sounds through the sound holes 1*a* and 1*b* of the mobile phone housing portion 1 in a state where the range of the directivity spreads.

According to the first embodiment, the mobile phone housing portion 1 is so formed that the opening lengths L7 and L8 of the respective ones of the sound holes 1*a* and 1*b* are larger (L7>L3 and L8>L4) than the opening lengths L3 and L4 of the respective ones of the sound holes 31*a* and 31*b* on the upper surface 30*a* of the gasket 30 in contact with the back surface (Z1) of the mobile phone housing portion 1 in the direction Y. Thus, sounds outside the mobile phone 200 can be reliably collected in a state of further spreading the directivity possessed by the differential microphone unit 100 with the sound holes 1*a* and 1*b* of the mobile phone housing portion 1.

According to the first embodiment, the vibrating portion 11 is arranged in the MEMS chip 12 on the substrate 10 on the side where the sound hole 22*a* and the sound hole 22*b* are opposed to each other in the direction X. Thus, the sound paths can be formed by easily reducing the difference between the length of the path A (see FIG. 4) and the length of the path B (see FIG. 4), unlike a case where the vibrating portion 11 is arranged on the substrate 10 in a region on the side opposite to the region where the sound hole 22*a* and the sound hole 22*b* are opposed to each other.

According to the first embodiment, the vibrating portion 11 is arranged on the straight line (line 500-500 shown in FIG. 6) passing through the central position of the sound hole 22*a* and the central position of the sound hole 22*b*. Thus, the length of the path A (see FIG. 4) and the length of the path B (see FIG. 4) can both be formed as short as possible, unlike a case where the vibrating portion 11 is arranged on a region other than on the straight line. Thus, the path lengths so decrease that sound paths can be formed in which the difference caused between the path lengths is easily suppressed.

According to the first embodiment, the differential microphone unit 100 is stored in the mobile phone housing portion 1 in the state of matching the direction X where the sound holes 22*a* and 22*b* align with each other and the longitudinal direction of the mobile phone housing portion 1 with each other. Thus, the region having no directivity (the Null range) formed in the mobile phone 200 can be effectively narrowed in the longitudinal direction (direction X) of the mobile phone 200. Thus, flexibility of design at a time of assembling the differential microphone unit 200 into the mobile phone housing portion 1 along the longitudinal direction can be improved.

Second Embodiment

Figure 13:
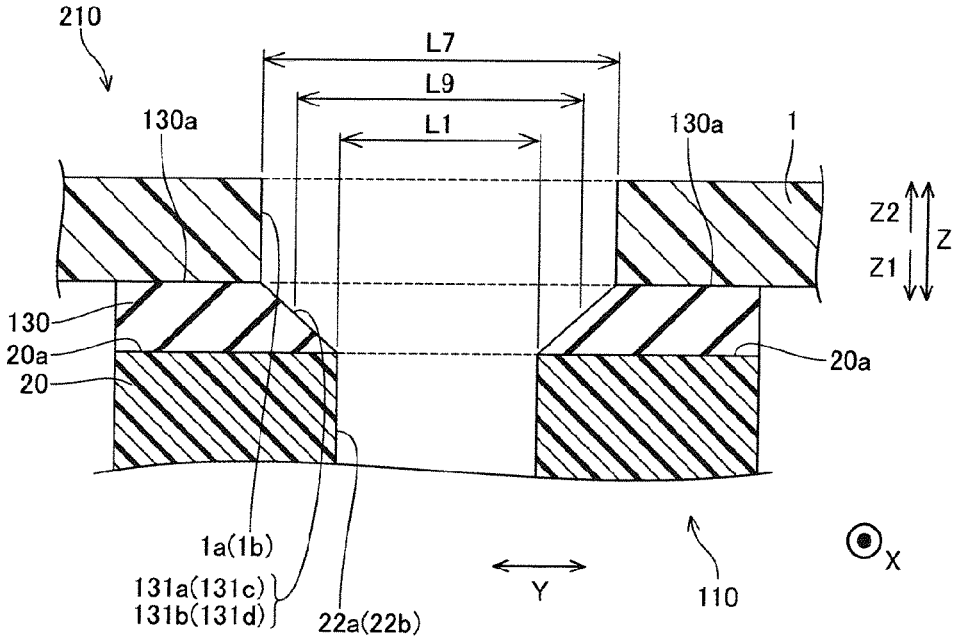
FIG. 13 An enlarged sectional view showing the structure of the differential microphone unit of the mobile phone according to the second embodiment of the present invention.
Figure 14:
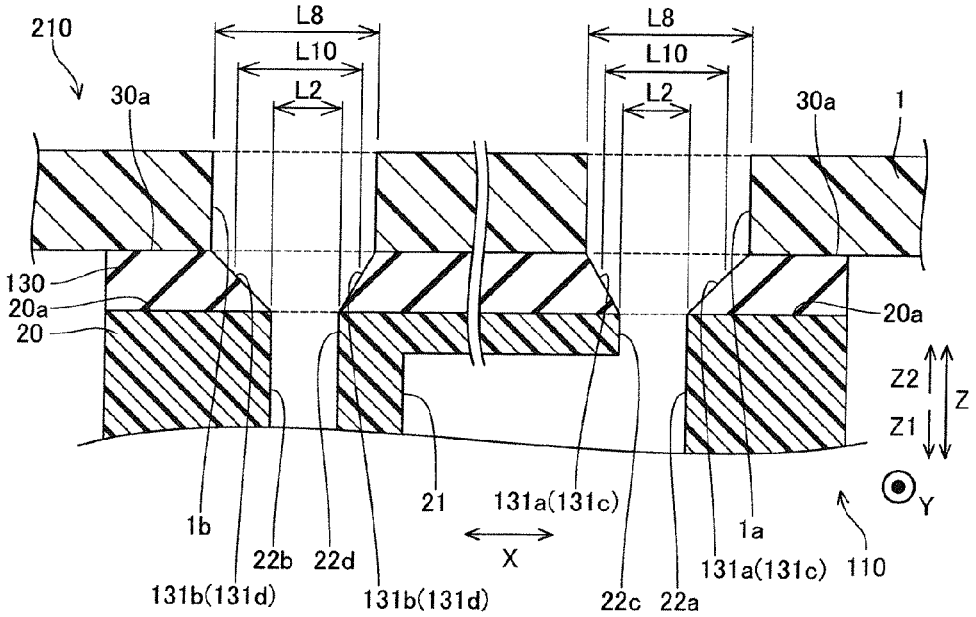
FIG. 14 An enlarged sectional view showing the structure of the differential microphone unit of the mobile phone according to the second embodiment of the present invention.

A second embodiment of the present invention is now described with reference to FIGS. 12 to 14. With reference to a mobile phone 210 according to this second embodiment, such a case is described that a gasket 130 having sound holes 131*a* and 131*b* whose inner side surfaces 131*c* and 131*d* are formed in a bowl-like manner is arranged on an upper surface 20*a* of a cover portion 20, unlike the aforementioned first embodiment. FIG. 13 shows a section in a case of viewing a differential microphone unit 110 from a position similar to that in the case of viewing the differential microphone unit 100 according to the aforementioned first embodiment along the line 400-400 in FIG. 6, and FIG. 14 shows a section in a case of viewing the differential microphone unit 110 from a position similar to that in the case of viewing the differential microphone unit 100 along the line 500-500 in FIG. 6. Referring to the figures, the same signs as those in the aforementioned first embodiment are assigned to and show structures similar to those of the aforementioned first embodiment.

Figure 12:
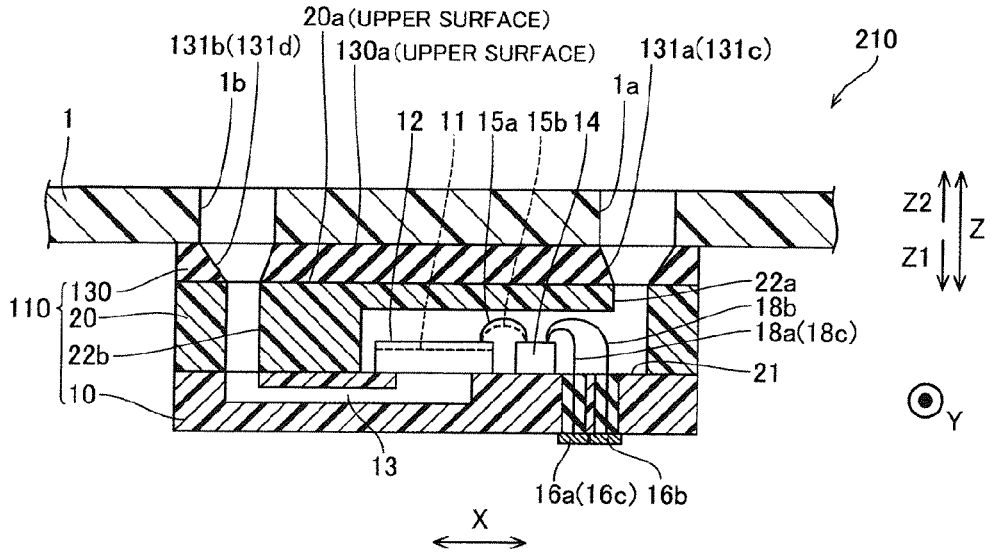
FIG. 12 A sectional view showing the structure of a differential microphone unit of a mobile phone according to a second embodiment of the present invention.

In the mobile phone 210 according to the second embodiment of the present invention, the gasket 130 is arranged on the upper surface 20*a* of the cover portion 20 having a structure similar to that in the aforementioned first embodiment so that the differential microphone unit 110 is constituted, as shown in FIG. 12.

According to the second embodiment, the slot-shaped sound holes 131*a* and 131*b* are formed in the gasket 130 at positions corresponding to the respective ones of slot-shaped sound holes 22*a* and 22*b* of the cover portion 20 respectively, as shown in FIG. 12. The sound holes 131*a* and 131*b* are examples of the "second sound holes" in the present invention.

According to the second embodiment, the sound hole 131*a* (sound hole 131*b*) is formed to have an inner side surface 131*c* (131*d*) so inclined that an opening length L9 increases (L1≤L9≤L7) from a surface (the lower surface) of the gasket 130 on the side of the cover portion 20 toward the back surface (the upper surface 130*a* on the side opposite to the side of the cover portion 20) of a mobile phone housing portion 1 in a direction Y, as shown in FIG. 13. Further, the inner side surface 131*c* (131*d*) is so formed that an opening length L10 increases (L2≤L10≤L8) from the surface (lower surface) of the gasket 130 on the side of the cover portion 20 toward the back surface (upper surface 130*a* on the side opposite to the side of the cover portion 20) of the mobile phone housing portion 1 also in a direction X, as shown in FIG. 14. The upper surface 130*a* is an example of the "surface on the side opposite to the side of the microphone housing" in the present invention.

According to the second embodiment, therefore; the mobile phone 210 is so formed that the opening lengths L9 and L10 of the sound hole 131*a* (sound hole 131*b*) on the surface (the lower surface) on the side of the cover portion 20 are identical to the opening lengths L1 and L2 of the sound hole 22*a* (22*b*) on the upper surface 20*a* of the cover portion 20, respectively. Further, the mobile phone 210 is so formed that the opening lengths L9 and L10 of the sound hole 131*a* (sound hole 131*b*) On the surface (the upper surface 130*a*) on the side of the mobile phone housing portion 1 are identical to the opening lengths L1 and L2 of a sound hole 1*a* (1*b*) on the back surface of the mobile phone housing portion 1, respectively.

The remaining structure of the mobile phone 210 according to the second embodiment is similar to that of the aforementioned first embodiment.

According to the second embodiment, as hereinabove described, the respective ones of the sound holes 131*a* and 131*b* are formed to have the inner side surfaces 131*c* and 131*d* so inclined that the opening lengths L9 increase from the surface (the lower surface) of the gasket 130 on the side of the cover portion 20 toward the upper surface 130*a* on the side opposite to the side of the cover portion 20 at least in the direction Y. Thus, the opening length of the sound hole 131*a* (131*b*) of the gasket 130 on the side of the sound hole 22*a* (22*b*) (side of the cover portion 20) can be reduced, whereby the opening length of the sound hole 131*a* (131*b*) on the side of the sound hole 22*a* (22*b*) can be approximated to the opening length L1 of the sound hole 22*a* (22*b*). Thus, the length of a discontinuous portion (step portion) resulting from the difference between the opening lengths of the sound hole 22*a* (22*b*) and the sound hole 131*a* (131*b*) in the direction Y can be inhibited from increasing on a connected portion between the sound hole 22*a* (22*b*) and the sound hole 131*a* (131*b*), whereby a sound collecting state of the differential microphone unit 110 can be improved.

According to the second embodiment, the opening lengths L10 and L9 of the sound hole 131*a* (131*b*) on the surface (lower surface) on the side of the cover portion 20 in the directions X and Y are identical to the opening lengths L2 and L1 of the sound hole 22*a* (22*b*) of the cover portion 20 in the directions X and Y, respectively. Thus, the inner side surface 131*c* (131*d*) of the sound hole 131*a* (131*b*) of the gasket 130 forms an inclined surface from a starting point of an edge portion of the sound hole 22*a* (22*b*) on a side in contact with the gasket 130 along the thickness direction (the Z2 direction) of the gasket 130, whereby no step portion (discontinuous portion) can be formed on the connected portion between the sound hole 22*a* (22*b*) and the sound hole 131*a* (131*b*), and the sound collecting state of the differential microphone unit 110 can be improved as a result.

According to the second embodiment, the opening lengths L10 and L9 of the sound hole 131*a* (131*b*) on the surface (upper surface 130*a*) on the side of the mobile phone housing portion 1 in the directions X and Y are identical to the opening lengths L8 and L7 of the sound hole 1*a* (1*b*) of the mobile phone housing portion 1 in the directions X and Y, respectively. Thus, the inner side surface 131*c* (131*d*) of the sound hole 131*a* (131*b*) of the gasket 130 forms an inclined surface from a starting point of an edge portion of the sound hole 22*a* (22*b*) on a side in contact with the gasket 130 along the thickness direction (the Z2 direction) of the gasket 130, whereby no step portion (discontinuous portion) can be formed in the connected portion between the sound hole 22*a* (22*b*) and the sound hole 131*a* (131*b*), and the sound collecting state of the differential microphone unit 110 can be improved as a result.

The remaining effects of the second embodiment are similar to those of the aforementioned first embodiment.

The embodiments disclosed this time must be considered as illustrative in all points and not restrictive. The range of the present invention is shown not by the above description of the embodiments but by the scope of the claims for patent, and all modifications within the meaning and range equivalent to the scope of the claims for patent are included.

Figure 15:
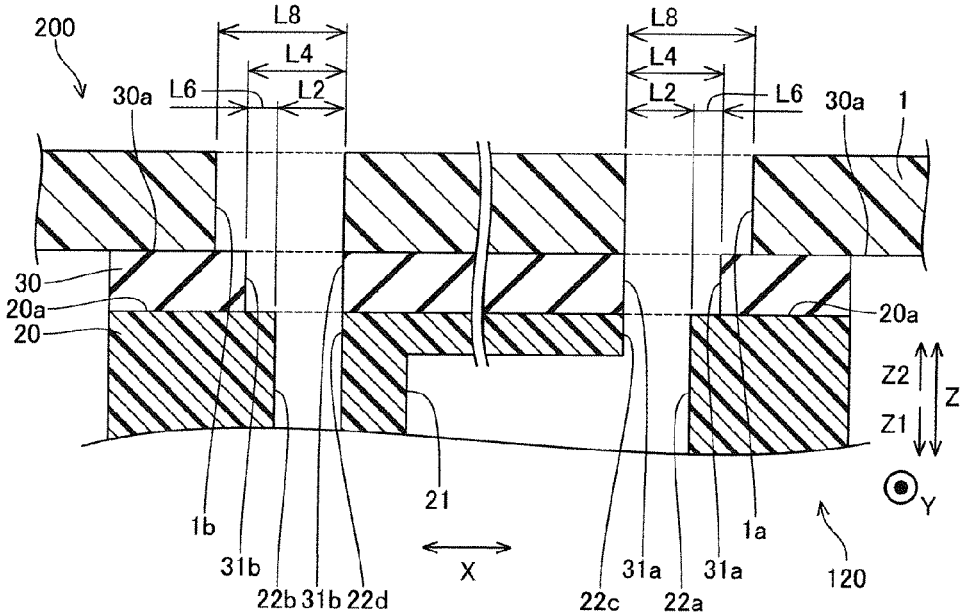
FIG. 15 An enlarged sectional view showing the structure of a differential microphone unit according to a modification of the present invention.

For example, while the example of forming the differential microphone unit 100 so that a step (L5>0 in FIG. 8) is provided between the inner side surface 22*c* (22*d*) of the sound hole 22*a* (22*b*) on the side where the sound hole 22*a* and the sound hole 22*b* are opposed to each other in the direction X and the inner side surface 31*c* (31*d*) of the sound hole 31*a* (31*b*) arranged above (Z2 side) the sound hole 22*a* (22*b*) has been shown in the aforementioned first embodiment, the present invention is not restricted to this. According to the present invention, a differential microphone unit 120 may be so formed that an inner side surface 22*c* (22*d*) of a sound hole 22*a* (22*b*) on a side where the sound hole 22*a* and the sound hole 22*b* are opposed to each other in a direction X and an inner side surface 31*c* (31*d*) of a sound hole 31*a* (31*b*) arranged on the upper side (Z2 side) are in the same plane (the case of L5=0 in FIG. 8), as in a modification shown in FIG. 15. FIG. 15 shows a section in a case of viewing the differential microphone unit 120 along the line 500-500 in FIG. 6. When forming the differential microphone unit 100 similarly to this modification, no first distance denoted by L5 is so provided that the distance between the sound holes 22*a* and 22*b* along the direction X can be reduced, whereby the size of the differential microphone unit 100 can be more inhibited from increasing.

While an inner side surface of a sound hole 31*a* (31*b*) on a side opposite to the side where the sound hole 22*a* and the sound hole 22*b* are opposed to each other in the direction X is formed in the shape of a step with respect to the inner side surface of the sound hole 22*a* (22*b*) in the aforementioned first embodiment in the case of the modification shown in FIG. 15, the present invention is not restricted to this, but the inner side surface may be so inclined and formed that an opening length increases from a surface (lower surface) of a gasket 30 on the side of a cover portion 20 toward an upper surface 30*a* opposite to the side of the cover portion 20, similarly to the aforementioned second embodiment.

While the example of forming the sound hole 22*a* (22*b*) and the sound hole 31*a* (31*b*) (sound hole 131*a* (131*b*) in the second embodiment) to both have slot shapes (oval shapes) has been shown in each of the aforementioned first and second embodiments, the present invention is not restricted to this. According to the present invention, the sound holes provided on the cover portion 20 and the gasket 30 (130) may be formed to have elliptic shapes, for example, other than the slot shapes. In this case, the sound holes are preferably so formed that major axis directions of the elliptic shapes correspond to the "second direction" in the present invention.

We claim:

1. A differential microphone unit comprising:

a microphone housing in which a pair of first sound holes are provided on the same major surface, said pair of first sound holes are formed to align with each other at a first distance along a longitudinal direction of the differential microphone unit and are further formed to extend along a short-side direction of the differential microphone unit;

a vibrating portion arranged in said microphone housing for vibrating due to a difference between sound pressures arriving through the respective ones of said pair of first sound holes; and a sealing member arranged on the major surface of said microphone housing, including a pair of second sound holes arranged to communicate with the respective ones of said pair of first sound holes, said pair of second sound holes are formed to align with each other at a second distance along a longitudinal direction of said differential microphone unit and are further formed to extend along a short-side direction of said differential microphone unit;

wherein:

said sealing member is so formed that, in a second direction orthogonal to a first direction where said pair of first sound holes align with each other, opening lengths of the respective ones of said pair of second sound holes on a surface of said sealing member opposite to the side of said microphone housing are larger than opening lengths of said first sound holes in said second direction on the major surface of said microphone housing.

2. The differential microphone unit according to claim 1, wherein:

said first sound holes are arranged in regions surrounded by inner side surfaces of said second sound holes communicating with the first sound holes.

3. The differential microphone unit according to claim 1, wherein:

central positions of the respective ones of said pair of first sound holes are arranged along said first direction.

4. The differential microphone unit according to claim 1, wherein:

the opening lengths of said first sound holes in said second direction are larger than opening lengths of said first sound holes in said first direction, and the opening lengths of said second sound holes in said second direction are larger than opening lengths of said second sound holes in said first direction.

5. The differential microphone unit according to claim 4, wherein:

said pairs of first sound holes and second sound holes both have slot shapes extending along said second direction.

6. The differential microphone unit according to claim 5, wherein:

said slot shapes are track shapes.

7. The differential microphone unit according to claim 1, wherein:

the difference between the opening lengths of said second sound holes in said second direction on a surface of said sealing member opposite to the side of said microphone housing and the opening lengths of said first sound holes in said second direction on the major surface of the microphone housing is larger than the difference between opening lengths of said second sound holes in said first direction on the surface of said sealing member opposite to the side of said microphone housing and opening lengths of said first sound holes in said first direction on the major surface of said microphone housing.

8. The differential microphone unit according to claim 1, wherein:

a first distance from inner side surfaces of said first sound holes on a side where said pair of first sound holes are opposed to each other in said first direction up to inner side surfaces of said second sound holes communicating with said first sound holes is smaller than a second distance from inner side surfaces of said first sound holes on a side opposite to the side where said pair of first sound holes are opposed to each other up to the inner side surfaces of said second sound holes communicating with said first sound holes.

9. The differential microphone unit according to claim 8, wherein:

the inner side surfaces of said first sound holes on the side where said pair of first sound holes are opposed to each other in said first direction and the inner side surfaces of said second sound holes communicating with said first sound holes are arranged on the same plane.

10. The differential microphone unit according to claim 8, so formed that:

central positions of said first sound holes in said first direction and central positions of said second sound holes communicating with said first sound holes in said first direction do not overlap with each other, and central positions of said first sound holes in said second direction and central positions of said second sound holes communicating with the first sound holes in said second direction overlap with each other.

11. The differential microphone unit according to claim 1, wherein:

said second sound holes have inner side surfaces so inclined that opening lengths increase from the surface of said sealing member on the side of said microphone housing toward a surface opposite to the side of said microphone housing at least in said second direction.

12. The differential microphone unit according to claim 11, wherein:

opening lengths of said second sound holes on the surface of said sealing member on the side of said microphone housing are identical to opening lengths of said first sound holes of said microphone housing.

13. The differential microphone unit according to claim 1, wherein:

said sealing member is so formed that opening lengths of the respective ones of said pair of second holes on the surface of said sealing member opposite to the side of said microphone housing are larger than opening lengths of said first sound holes in said first direction on the major surface of said microphone housing in said first direction.

14. The differential microphone unit according to claim 1, wherein:

said sealing member is arranged to seal a space between a back surface side of a product housing, having a pair of third sound holes, in which said differential microphone unit is stored and said microphone housing, and the respective ones of said pair of second sound holes are formed to communicate with the respective ones of said pair of third sound holes provided on said product housing.

15. The differential microphone unit according to claim 14, wherein:

said second sound holes have inner side surfaces so inclined that opening lengths increase from the surface of said sealing member on the side of said microphone housing toward the surface opposite to the side of said microphone housing at least in said second direction, and the opening lengths of said second sound holes on a surface of said sealing member on the side of said product housing are identical to opening lengths of said third sound holes of said product housing.

16. The differential microphone unit according to claim 1, wherein:

said vibrating portion is arranged in said microphone housing on the side where said pair of first sound holes are opposed to each other in said first direction.

17. The differential microphone unit according to claim 16, wherein:

central positions of the respective ones of said pair of first sound holes are arranged along said first direction, and said vibrating portion is arranged on a straight line passing through the central positions of the respective ones of said pair of first sound holes.

18. A mobile apparatus comprising:

a differential microphone unit including:

a microphone housing in which a pair of first sound holes are provided on the same major surface, said pair of first sound holes are formed to align with each other at a first distance along a longitudinal direction of said differential microphone unit and are further formed to extend along a short-side direction of said differential microphone unit;

a vibrating portion arranged in said microphone housing for vibrating due to a difference between sound pressures arriving through the respective ones of said pair of first sound holes; and a sealing member, arranged on the major surface of said microphone housing, including a pair of second sound holes arranged to communicate with the respective ones of said pair of first sound holes, in which:

said sealing member is so formed that, in a second direction orthogonal to a first direction where said pair of first sound holes align with each other, opening lengths of the respective ones of said pair of second sound holes on a surface of said sealing member opposite to a side in contact with said microphone housing are larger than opening lengths of said first sound holes in said second direction on the major surface of said microphone housing; and said pair of second sound holes are formed to align with each other at a second distance on a longitudinal direction of said differential microphone unit and are further formed to extend along a short-side direction of said differential microphone unit; and a mobile apparatus housing in which said differential microphone unit is stored, wherein:

said sealing member is arranged to seal a space between a back surface side of said mobile apparatus housing, having a pair of third sound holes, in which said differential microphone unit is stored and said microphone housing, and the respective ones of said pair of second sound holes are formed to communicate with the respective ones of said pair of third sound holes provided on said mobile apparatus housing.

19. The mobile apparatus according to claim 18, wherein:

said mobile apparatus housing is so formed that opening lengths of the respective ones of said pair of third sound holes are larger than opening lengths of the respective ones of said pair of second sound holes on a surface of said sealing member in contact with the back surface of said mobile apparatus housing in said second direction.

20. The mobile apparatus according to claim 18, wherein: said differential microphone unit is stored in said mobile apparatus housing in a state of matching the first direction where said pair of first sound holes align with each other and the longitudinal direction of said mobile apparatus housing with each other.

* * * * *